US006098687A

United States Patent [19]

Ishibuchi et al.

[11] Patent Number: 6,098,687

[45] Date of Patent: Aug. 8, 2000

[54] SINGLE FACER WITH ANGLED MEDIUM FEEDING

[75] Inventors: Hiroshi Ishibuchi; Hiroyuki Takenaka; Kazukiyo Kohno; Makoto Ando, all of Hiroshima-ken, Japan

[73] Assignee: Mitsubishi Heavy Industries, Ltd., Tokyo, Japan

[21] Appl. No.: 09/123,488

[22] Filed: Jul. 28, 1998

[30] Foreign Application Priority Data

Oct. 22, 1997 [JP] Japan ..... 9-289863

[51] Int. Cl.[7] ..... B31F 1/28; B31F 1/36

[52] U.S. Cl. ..... 156/473; 156/472

[58] Field of Search ..... 156/470, 471, 156/472, 473, 205, 210

[56] References Cited

U.S. PATENT DOCUMENTS

| | | | |
|---|---|---|---|
| 2,236,056 | 3/1941 | Grimm | 156/205 |
| 2,960,144 | 11/1960 | Graf | 156/472 |
| 3,492,188 | 1/1970 | Wandel | 156/470 |
| 4,267,008 | 5/1981 | Owens | 156/470 |
| 5,628,865 | 5/1997 | Marschke | 156/473 |
| 5,647,947 | 7/1997 | Yasui et al. | 156/472 |
| 5,897,824 | 4/1999 | Marschke | 156/205 |
| 5,925,209 | 7/1999 | Mosburger | 156/210 |

FOREIGN PATENT DOCUMENTS 6-9898 2/1994 Japan .

*Primary Examiner*—Michael W. Ball
*Assistant Examiner*—Barbara J Musser
*Attorney, Agent, or Firm*—Armstrong, Westerman, Hattori, McLeland & Naughton

[57] ABSTRACT

The present invention relates to a single facer, which comprises a humidifying and heating unit placed on the upstream side of an air pressurization corrugating mechanism for humidifying and heating a corrugating medium and a feed mechanism for supplying the corrugating medium, processed by the humidifying and heating unit, to the air pressurization corrugating mechanism at a given speed. The corrugating medium is supplied at the given speed after the humidification and heating process for the corrugating medium, so that an air pressure to be taken at the corrugation is reducible and a predetermined flute configuration is maintainable. In addition, the spring back of the corrugating medium hardly occurs, which makes it possible to manufacture a corrugated fiberboard sheet with a high shock absorbing ability.

32 Claims, 15 Drawing Sheets

SINGLE FACER WITH ANGLED MEDIUM FEEDING

BACKGROUND OF THE INVENTION

1. Field of the Invention

The present invention relates to a single facer suitable for consecutive manufacture of a single faced corrugated fiberboard.

2. Description of the Related Art

FIG. 12 is a side elevational and cross-sectional view illustratively showing a structure of a prior single facer, and FIG. 13 is an enlarged view showing a principal portion of FIG. 12. As shown in FIG. 12, a single facer 200, which consecutively manufactures a single faced corrugated fiberboard, comprises, in addition to an upper corrugating roll 1 having a corrugated surface (flutes) on its outer circumferential surface, a lower corrugating roll 2 and a pressure roll 3 in the form of a basic roll arrangement.

In this roll arrangement, the lower corrugating roll 2 is disposed at a position where a corrugating medium 4 can be interposed between the same lower corrugating roll 2 and the upper corrugating roll 1, with the lower corrugating roll 2 having, on its outer circumferential surface, flutes engaging with the upper corrugating roll 1. The pressure roll 3 is located on the downstream side of the upper corrugating roll 1 to come into contact with the flute tip portions of the outer circumference of the lower corrugating roll 2 under the action of an appropriate nip pressure.

In addition, in the lower corrugating roll 2 and at positions close to its outer circumferential surface, a plurality of transverse holes 10 are bored at an equal pitch interval on a concentric circle in parallel to the central axis of the lower corrugating roll 2. An end portion of each of these transverse holes 10 is placed into contact with a side end surface of the lower corrugating roll 2 and is made to communicate with a non-shown air suction unit (air suction source) through a sliding surface with the lower corrugating roll 2 and a piping system being in communication with some of the transverse holes 10. Further, in the circumferential surface of the lower corrugating roll 2, a plurality of circumferential slit grooves 11 are formed along the axial direction of the lower corrugating roll 2 at an adequate interval. The transverse holes 10, the circumferential slit grooves 11, the air suction unit and the piping system constitute an air suction mechanism.

That is, with this air suction mechanism, on operating the non-shown air suction unit, an air suction from the circumferential slit grooves 11 made in the circumferential surface of the lower corrugating roll 2 takes place through the piping system and the respective transverse holes 11.

The upper corrugating roll 1 and the lower corrugating roll 2 are for the purpose of shaping (corrugating) a corrugating medium 4 into a corrugated medium 6 while the corrugating medium 4 passes through an engaging section defined therebetween. At this time, a suction force generated due to the non-shown air suction unit causes the suction of the corrugated medium 6 through the transverse holes 10 and the circumferential slit grooves 11 to make it come closely into contact with the flute-made surface of the lower corrugating roll 2, with the lower corrugating roll 2 transferring the corrugated medium 6 up to a joining section between the lower corrugating roll 2 and the pressure roll 3 in a state of holding it in the closely contacting condition.

Furthermore, a gluing roll 7 is disposed on the downstream side of the location of the upper corrugating roll 1 but on the upstream side of the location of the pressure roll 3 on the circumferential surface of the lower corrugating roll 2, thereby applying a glue onto the flute tip portions of the corrugated medium 6. This gluing roll 7 rotates while coming into with a roll 7*a* rotating in a dipped condition into a glue 8 so that its entire circumferential surface always undergoes the even application of the glue 8, and rotates while coming into contact with the flute tip portions of the corrugated medium 6, thereby applying the glue 8 onto the flute tip portions of the corrugated medium 6.

On the other hand, on the downstream side of the location of the gluing roll 7 on the circumferential surface of the lower corrugating roll 2, the pressure roll 3 equipped with a non-shown heating unit is placed to come into contact with the lower corrugating roll 2. Further, this pressure roll 3 guides a linerboard 5 into a gap defined with respect to the lower corrugating roll 2, and further bonds (adheres) the linerboard 5 to the glue 8 applied corrugated medium 6 under pressure in the gap with the lower corrugating roll 2 in a state of heating by the non-shown heating unit, thus producing a single faced corrugated fiberboard sheet 9.

With this construction, the corrugating medium 4 is first guided by the upper corrugating roll 1 into a gap between the upper corrugating roll 1 and the lower corrugating roll 2 to be flute-shaped (corrugated) while passing through the engaging section between the upper corrugating roll 1 and the lower corrugating roll 2, thus producing the corrugated medium 6.

Subsequently, the corrugated medium 6 produced through the engaging section between the upper corrugating roll 1 and the lower corrugating roll 2 is drawn by the air suction mechanism, and delivered in accordance with the rotation of the lower corrugating roll 2 in a state of being brought closely into contact with the flute-made surface of the lower corrugating roll 2.

When the corrugated medium 6, being delivered by the lower corrugating roll 2, reaches the gap between the gluing roll 7 and the lower corrugating roll 2, the glue 8 is applied through the gluing roll 7 onto its flute tip portions, and then conveyed into the gap between the pressure roll 3 and the lower corrugating roll 2.

In the gap between the pressure roll 3 and the lower corrugating roll 2, the corrugated medium 6 holding the applied glue 8 on its flute tip portions and the linerboard 5 guided by the pressure roll 3 from a different direction are joined (adhered) to each other under pressure while being heated by the non-shown heating unit, thus creating the single faced corrugated fiberboard sheet 9. The created single faced corrugated fiberboard sheet 9 is shifted into the next process.

In the case of the prior single facer 200 thus constructed, as shown in FIG. 13, when the corrugating medium 4 is flute-shaped by the flutes formed on the upper corrugating roll 1 and the lower corrugating roll 2 in the engaging section between both the corrugating rolls 1, 2, the flutes of the both the corrugating rolls 1, 2 are strongly brought into pressing contact with each other in a state where the corrugating medium 4 is caught in therebetween, so that a nip pressure being as large as several tens kgf/cm$^2$ works between the flutes of both the corrugating rolls 1, 2 and slip occurs between the flutes through the corrugating medium 4 with the rotation of both the corrugating rolls 1, 2, which causes a strong frictional force to work on the tooth surfaces of the flutes being in gear with each other.

In addition, friction also occurs between the corrugating medium 4 and the tooth strings of both the corrugating rolls 1, 2 immediately before the engagement because of the sliding contact therebetween, which causes the flutes to be worn. Accordingly, even if the corrugating medium 4 with an ordinary quality is put to use, when being used for 0.5 to 1 year, each of the rolls working for the corrugation is required to be replaced with new one, or the flutes thereof are necessary to re-shave.

The friction phenomenon the flutes of the corrugating rolls 1, 2 experience depends greatly upon the quality of the corrugating medium, and particularly, in the case of use of a low-quality corrugating medium containing a large amount of hard impurities such as an ash content, the abrasion of the flutes of the corrugating rolls 1, 2 more takes place, which further shortens their service life. In an extreme case, there is the possibility that they can not be used if being put into operation for 2 to 3 months.

Moreover, the corrugating rolls 1, 2 are expensive, and the limit of the revival by the re-shaving is approximately three times and they are scraped afterwards, and hence, the business circles have intense aspirations toward a technical solution for effectively extending the service lives of the corrugating rolls 1, 2.

Besides, a detailed description will be made of the wearing phenomenon the flutes of the aforesaid corrugating rolls 1, 2 experience. The flutes of the upper corrugating roll 1 are further subject to the sliding friction with respect to the corrugating medium 4 or the corrugated medium 6 as compared with the lower corrugating roll 2 where the corrugated medium 6 is absorbed on its flute-made surface by the air suction mechanism, so that the abrasion of the flutes of the upper corrugating roll 1 is more considerable as compared to the flutes of the lower corrugating roll 2.

On the other hand, for solving the above-mentioned problems, there has been known a single facer in which, in place of the upper corrugating roll of the above-described prior single facer 200, an air pressurization corrugating mechanism is provided which accomplishes the corrugation by pressing a corrugating medium against flutes shaped on a circumferential surface of a lower corrugating roll through the use of an air pressure. That is, in this single facer, the upper corrugating roll 1 is omitted from the above-mentioned single facer 200 and only one roll equivalent to the lower corrugating roll 2 is used as the corrugating roll.

Referring to drawings, a description will be given of a single facer equipped with such a prior air pressurization corrugating mechanism. FIG. 14 is a side elevational and cross-sectional view illustratively showing the single facer, and FIG. 15 is an enlarged, side-elevational and cross-sectional view showing a principal section (where an air pressurization corrugating mechanism 12 is brought close to a lower corrugating roll 2) thereof.

As shown in FIG. 14, a prior single facer 210 with an air pressurization corrugating mechanism has substantially same construction as that of the above-mentioned FIG. 12 prior single facer 200 except that the upper corrugating roll 1 is removed and an air pressurization corrugating mechanism 12 is provided instead. In the illustrations, the same numerals as those in the above description signify the same or corresponding parts, and therefore, the detailed description thereof will be omitted for brevity.

The air pressurization corrugating mechanism 12 is, as shown in FIG. 15, composed of a nozzle body 13 for introducing high-pressure air 16, a sealing plate 14 placed at a lower corrugating roll 2 side end portion of the nozzle body 13 to extend along a circumferential surface of a lower corrugating roll 2, and a sealing member 15 mounted on a surface of the sealing plate 14 which is in an opposed relation to the lower corrugating roll 2 circumferential surface. The sealing member 15 has a circumferential dimension to cover at least two of the flutes made on the circumferential surface of the lower corrugating roll 2.

In the nozzle body 13, a transverse cross section of its air injection opening 13*a* assumes an elongated quadrangle forming a slit configuration, and in its inner-size transverse cross section, its long side approximately has the same length as that of the axial length of the lower corrugating roll 2, while its short side is substantially above the flute pitch of the lower corrugating roll 2.

In addition, as shown in FIGS. 14 and 15, the air pressurization corrugating mechanism 12 is situated on the upstream side of a gluing roll 7 along the outer circumference of the lower corrugating roll 2 to define a gap corresponding to the thickness dimension of a corrugating medium 4 with respect to the flute tip portions of the lower corrugating roll 2, and when the corrugating medium 4 is interposed between the sealing member 15 of the air pressurization corrugating mechanism 12 and the flute tip portions of the lower corrugating roll 2, the air leakage from the space between the nozzle body 13 and the front side (one side of the corrugating medium 4 which does not face the lower corrugating roll 2) surface of the corrugating medium 4 is relatively little, so that an airtight condition is substantially maintainable.

That is, in a manner that high-pressure air 16 is supplied from a non-shown air supply unit to the interior of the nozzle body 13, the space between the nozzle body 13 and the front side surface of the corrugating medium 4 is maintainable in a high-pressure atmosphere, so that a high static pressure can work on the front side surface of the corrugating medium 4.

With this construction, when the corrugating medium 4 is fed into the gap between the air pressurization corrugating mechanism 12 and the lower corrugating roll 2, as shown in FIG. 15, in the gap between the sealing plate 14 and sealing member 15 of the air pressurization corrugating mechanism 12 and the flute tip portions of the lower corrugating roll 2, the high-pressure air 16 supplied through the nozzle body 13 presses the corrugating medium 4 against the flute-made surface of the lower corrugating roll 2 at a stretch, thereby shaping the corrugating medium 4 into a corrugated medium 6.

Furthermore, on the rear surface side of the corrugating medium 4 (corrugated medium 6), an air suction mechanism sucks air existing in the gap between the rear surface of the corrugating medium 4 (corrugated medium 6) and the circumferential surface of the lower corrugating roll 2 through circumferential slit grooves 11 and transverse holes 10, and therefore, the space between the rear surface of the corrugating medium 4 (corrugated medium 6) and the circumferential surface of the lower corrugating roll 2 always goes into a negative-pressure condition, which assists the corrugating process for the corrugating medium 4 by the compressed air 16 jetted from the air pressurization corrugating mechanism 12.

Still further, owing to the action of the air suction mechanism, the corrugated medium 6 produced is drawn to the flute-made surface of the lower corrugating roll 2 to reach a closely contacting condition, and the occurrence of the spring back which is a phenomenon of returning to the original configuration on the removal of the stress working on the corrugated medium 6 is suppressible, and further, the corrugated medium 6 is conveyed to between the lower corrugating roll 2 and the pressure roll 3 in a state of being maintained in the closely contacting condition against the centrifugal force of the lower corrugating roll 2.

Incidentally, as well as the single facer 200 including the aforesaid upper corrugating roll 1, in the process that the corrugated medium 6 is transferred by the lower corrugating roll 2 to between the lower corrugating roll 2 and the pressure roll 3, the gluing roll 7 applies a glue 8 onto its flute tip portions, and subsequently, in the gap between the pressure roll 3 and the lower corrugating roll 2, the corrugated medium 6 is joined (adhered) to a linerboard 5, guided by the pressure roll 3 from a different direction, under pressure while being heated by a non-shown heating unit, thereby forming a single faced corrugated fiberboard 9. Further, the formed single faced corrugated fiberboard 9 is shifted to the next process.

However, in the case of such a prior single facer 210, when the high-pressure air 16 is jetted from the front surface side of the corrugating medium 4 in the corrugation processing for the corrugating medium 4 so that the rear surface thereof reaches the inter-flute bottom surface of the lower corrugating roll 2, the air pressure producing that high-pressure air 16 needs to be as high as approximately 3 to 5 $kg/cm^2$, and in this case, there are problems in that a strong compressed air supply unit becomes necessary and a large amount of air is necessary to consume.

In addition, at the corrugation processing for the corrugating medium 4 in the gap between the air pressurization corrugating mechanism 12 and the lower corrugating roll 2, a slight time is taken from when the corrugating medium 4 is subjected to the jetting of the high-pressure air 16 to start to deform until the rear surface thereof reaches the inter-flute bottom surface of the lower corrugating roll 2, and hence, before the corrugating medium 4 reaches the inter-flute bottom surface of the lower corrugating roll 2, the lower corrugating roll 2 rotates to enter the next flute forming process, with the result that, as shown in FIG. 16 (a side-elevational and cross-sectional view corresponding to FIG. 15), the height of the flutes of the corrugating medium 4 corrugated becomes lower than that of a single faced corrugated fiberboard sheet produced through the use of the single facer 200 shown in FIG. 12, which can deteriorate the shock absorbing ability of the corrugated fiberboard sheet finally produced. This tendency to decrease the flute height grows as the rotational speed of the lower corrugating roll 2 increases.

More specifically, FIG. 17A shows a flute configuration of the single faced corrugated fiberboard sheet 9 produced by the single facer 200 shown in FIG. 12 and FIG. 17B illustrates a flute configuration of the single faced corrugated fiberboard sheet 9 produced by the single facer 210 shown in FIG. 14, and as shown in FIGS. 17A and 17B, after the corrugation processing by the air pressurization corrugating mechanism 12, the flute configuration of the single faced corrugated fiberboard sheet 9 produced by the adhesion to the linerboard S is broken by the spring back, and its flute height H' becomes lower than the flute height H of the single faced corrugated fiberboard sheet 9 produced by the single facer 200, which can deteriorate the shock absorbing ability of the corrugated fiberboard sheet finally manufactured.

SUMMARY OF THE INVENTION

The present invention has been developed with a view to eliminating the above-mentioned problems, and it is therefore an object of this invention to provide a single facer which is capable of, by supplying a corrugating medium at a given speed after humidification and heat processing of the corrugating medium, reducing the air pressure to be taken at the corrugation processing, maintaining a given flute configuration, and manufacturing a corrugated fiberboard sheet with a high shock absorbing ability by suppressing the occurrence of the spring back of the corrugating medium.

For this purpose, a single facer according to this invention is composed of a corrugating roll for corrugation-processing a corrugating medium, an air pressurization corrugating mechanism for applying an air pressure to the corrugating medium to press the corrugating medium against the corrugating roll, a pressing mechanism for pressing a linerboard, fed in a different way, against the corrugating medium corrugated by the air pressurization corrugating mechanism and the corrugating roll for adhesion therebetween to produce a single faced corrugated fiberboard sheet, a humidifying and heating unit placed on the upstream side of the air pressurization corrugating mechanism for humidifying and heating the corrugating medium, and a feed mechanism for feeding the corrugating medium, processed by the humidifying and heating unit, to the air pressurization corrugating mechanism at a given or predetermined speed.

In this case, it is also appropriate that the foregoing single facer includes an air suction mechanism for sucking air from between the corrugating roll and the corrugating medium so that the corrugating medium is drawn to a circumferential surface of the corrugating roll.

Furthermore, the single facer can further comprises a medium feed guide which guides the corrugating medium to make a given or predetermined angle $\theta$ ($\theta$ approximately equals 90 degrees$-\theta_0$; $\theta_0$=pressure angle of a flute of the corrugating roll) with respect to a tangential line to the lower corrugating roll when the corrugating medium is supplied into the gap between the air pressurization corrugating mechanism and the corrugating roll.

Still further, in the single facer, the feed mechanism can comprises a feed roller which rotates in a state of coming into contact with the corrugating medium to forward the corrugating medium into the air pressurization corrugating mechanism at a given or predetermined speed, a feed roller rotating motor for rotationally driving the feed roller, a feed roller controller for controlling the operation of the feed roller rotating motor to control the rotational speed of the feed roller, a corrugating roll rotating motor for rotationally driving the corrugating roll, and a corrugating roll controller for controlling the operation of the corrugating roll rotating motor to control the rotational speed of the corrugating roll, with the corrugating roll controller sending information indicative of the rotational speed of the corrugating roll to the feed roller controller to make the feed roller controller control the feed roller rotating motor so that the feed roller is rotated at a rotational speed obtained by multiplying the rotational speed sent from the corrugating roll controller by a take up ratio of the corrugating roll.

Moreover, in the single facer, the pressing mechanism can be constructed as a belt pressurization mechanism including an endless pressure belt for pressing a linerboard to the corrugating roll side in a state where the corrugating medium corrugation-processed is interposed therebetween.

Besides, the single facer can be equipped with a noise intercepting structure located around the air pressurization corrugating mechanism for intercepting noises generated by the air pressurization corrugating mechanism.

In addition, in the single facer, the humidifying and heating unit can comprise a shower unit for spouting water to the corrugating medium for humidification and a heating roll for heating the corrugating medium by rotating while coming into contact with the corrugating medium for heating. It is also possible that the humidifying and heating unit comprises a watering roll for applying water to the corrugating medium by rotating in a state of coming into contact with it for humidification and a heating roll for heating the corrugating medium by rotating while coming into contact with it for heating. Meanwhile, it is also appropriate that the humidifying and heating unit is constructed as a steam unit having an internal space filled with a high-temperature steam for conducting the humidification and heating concurrently with respect to the corrugating medium passing through the internal space.

Accordingly, with the single facer according to this invention, since the humidifying and heating unit for humidifying and heating the corrugating medium is provided on the upstream side of the air pressurization corrugating mechanism, the corrugating medium has a larger plastic deformability to suppress the spring back after the corrugation of the corrugating medium, thereby preventing the shock absorbing ability of the finally produced corrugated fiberboard sheet from lowering due to the collapse of the corrugation of the single faced fiberboard sheet resulting from the spring back. Further, the force required for the formation of the corrugating medium decreases, which can considerably reduce the air pressure to be needed at the corrugation processing for the corrugating medium in the air pressurization corrugating mechanism.

In addition, since the feed mechanism is provided to supply the corrugating medium processed by the humidifying and heating unit to the air pressurization corrugating mechanism at a given speed, smooth corrugation processing of the corrugating medium becomes possible, thereby considerably reducing the air pressure to be needed at the corrugation processing for the corrugating medium in the air pressurization corrugating mechanism.

Moreover, the installation of the feed mechanism for supplying the corrugating medium processed by the humidifying and heating unit to the air pressurization corrugating mechanism at a given speed can prevent the supply of the corrugating medium from being delayed with respect to the processing velocity at the corrugation processing for the corrugating medium in the air pressurization corrugating mechanism, so that the delay of the formation is preventable to eliminate the problem that the flute height of the corrugated medium lowers, which makes it possible to manufacture a single faced corrugated fiberboard sheet with a high shock absorbing ability.

DESCRIPTION OF THE PREFERRED EMBODIMENTS

Figure 1:
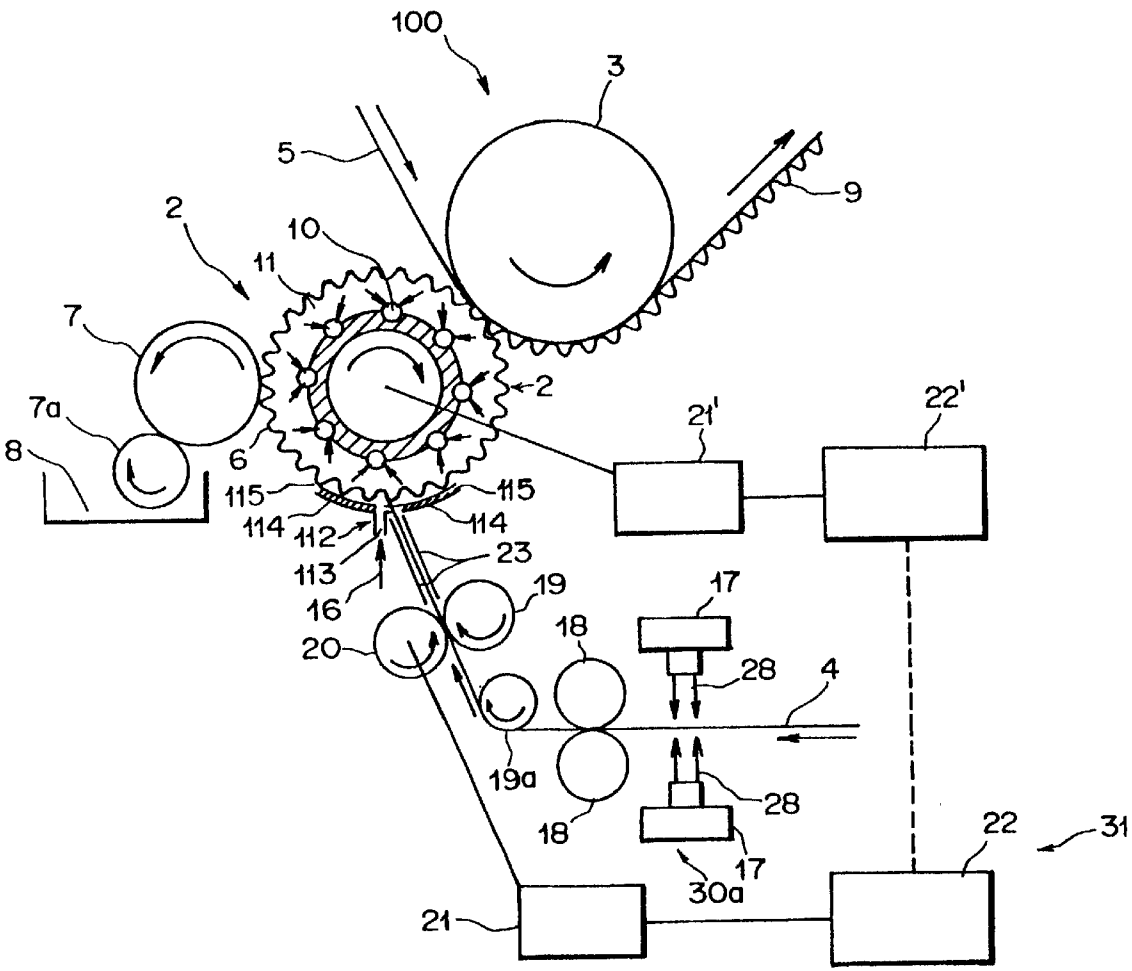
FIG. 1 illustratively shows a construction of a single facer according to an embodiment of the present invention.

Referring to the drawings, a description will be made hereinbelow of an embodiment of the present invention.

(A) Description of an Embodiment of the Invention

Figure 2:
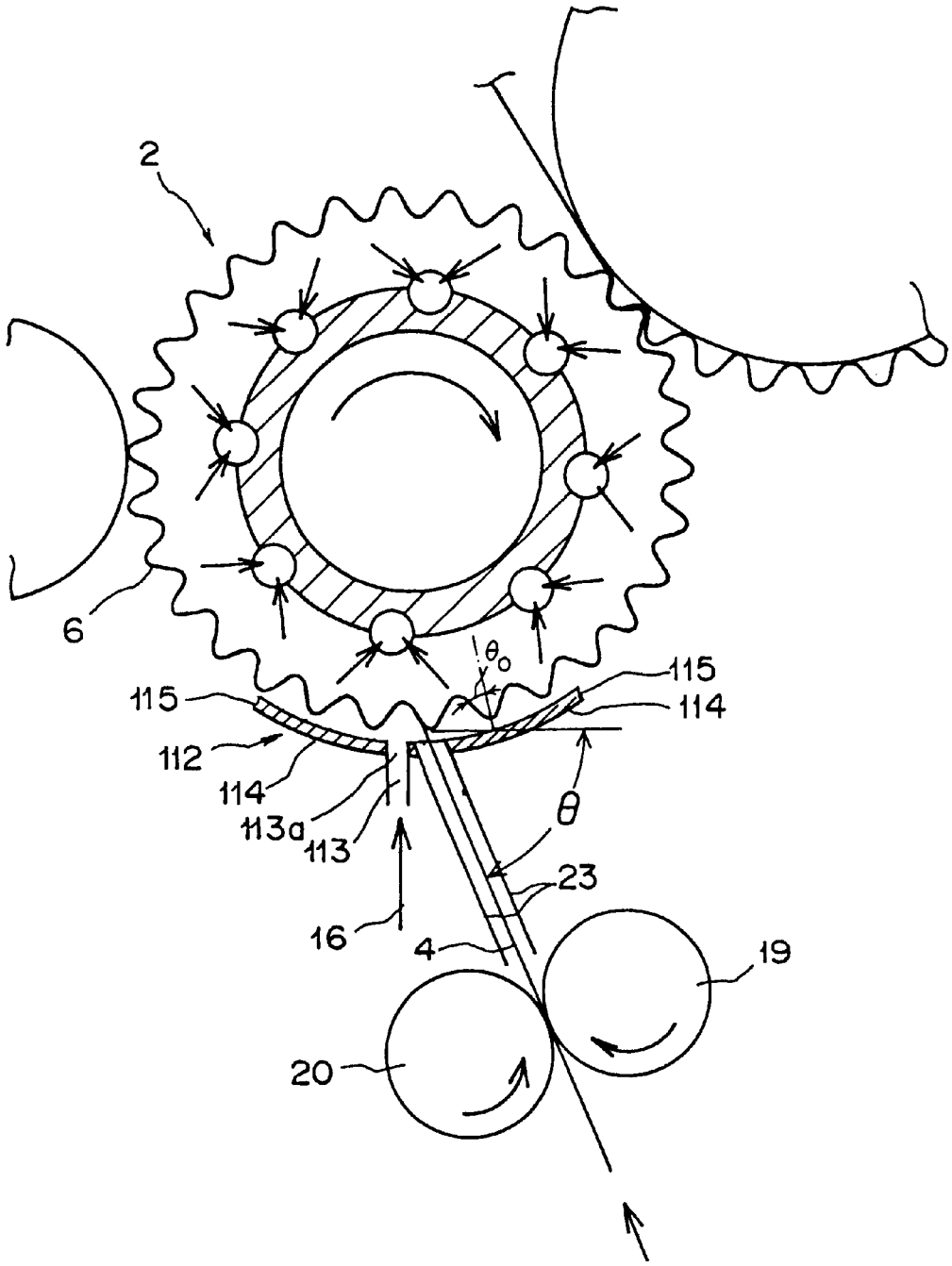
FIG. 2 is an illustration of a principal portion of the single facer shown in FIG. 1.
Figure 14:
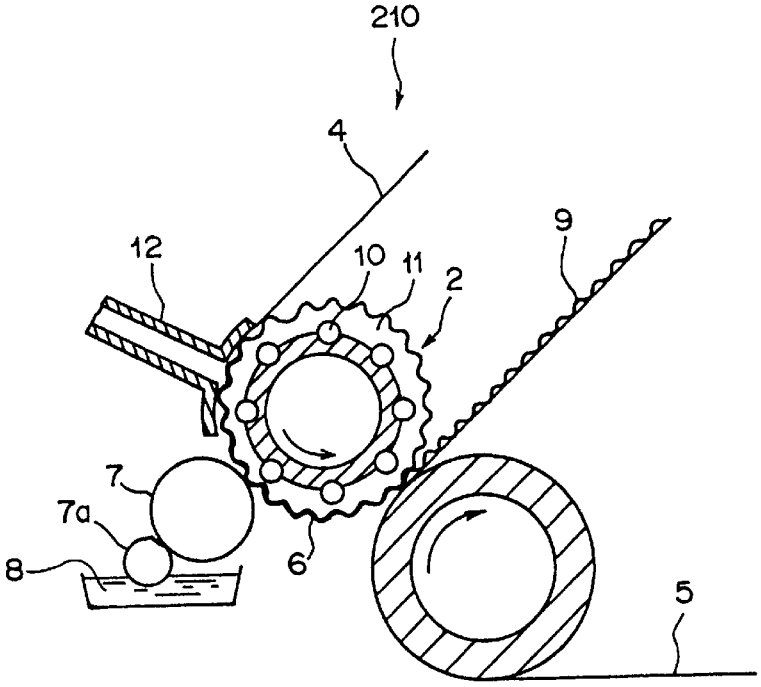
FIG. 14 PRIOR ART
FIG. 14 is a side-elevational and cross-sectional view illustratively showing a construction of a different prior single facer.
Figure 15:
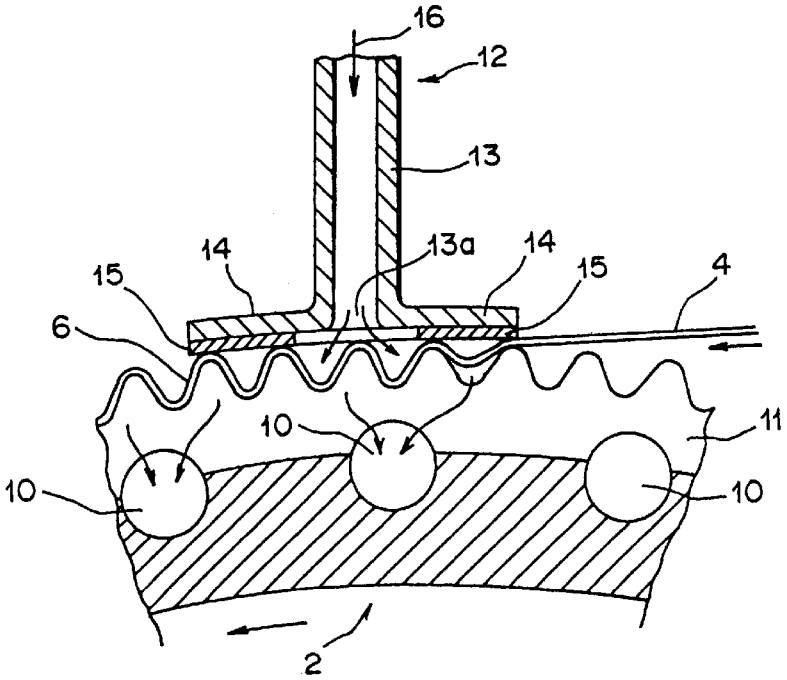
FIG. 15 PRIOR ART
FIG. 15 is an enlarged side-elevational and cross-sectional view showing a principal portion of the different prior single facer.

FIG. 1 illustratively shows a construction of a single facer according to an embodiment of this invention, and FIG. 2 is an illustration of a principal portion of the single facer shown in FIG. 1. As shown in FIG. 1, a single face, generally designated at numeral 100, comprises a lower corrugating roll 2, a pressure roll 3, a gluing roll 7 and an air pressurization corrugating mechanism 112 as well as the prior single facer 210 shown in FIG. 14, and further includes a humidifying and heating unit 30*a* and a feed mechanism 31. The same numerals as the aforesaid numerals represent the same or corresponding parts, and the description thereof will be omitted for simplicity.

The air pressurization corrugating mechanism 112 relates to improvement of the air pressurization corrugating mechanism 12 used in the single facer 210, and is composed of a nozzle body 113, a sealing plate 114, a sealing member 115 and medium feed guides 23.

The nozzle body 113 of the air pressurization corrugating mechanism 112 has an air jetting opening 113*a* which is constructed as a slit extending over the axial overall length of the lower corrugating roll 2, with this slit being divided equally into a plurality of sections along the axial directions of the lower corrugating roll 2. Whereupon, each of the equal divisions of the slit forms an elongated quadrangle in which its long side assumes several hundreds mm while its short side substantially corresponds to the flute pitch of the lower corrugating roll 2. Further, this nozzle body 113 is in communication with an non-shown compressed air supply unit so that high-pressure air 16 can be jetted toward the circumferential surface of the lower corrugating roll 2.

In addition, at a lower corrugating roll 2 side end portion of the nozzle body 113, the sealing plate 114 having a length substantially equal to the axial length of the lower corrugating roll 2 are located on the upstream and downstream sides of the nozzle body 113 to extend along the circumferential surface of the lower corrugating roll 2. Further, the sealing member 115 is adhered to the surface of the sealing plate 114 which is in opposed relation to the circumferential surface of the lower corrugating roll 2.

Besides, the sealing member 115 is adhered to the substantial whole of the surface of the sealing plate 114 which faces the circumferential surface of the lower corrugating roll 2, and has a dimension in the circumferential direction of the lower corrugating roll 2 to cover at least two of the flutes on the circumferential surface of the lower corrugating roll 2 and further has a dimension in the axial direction of the lower corrugating roll 2 to cover the width of the corrugating medium 4.

Moreover, in this air pressurization corrugating mechanism 112, the medium feed guides 23 are protrusively provided on the upstream side of the location of the nozzle body 113 (the position of the air jetting opening 113*a*), and the corrugating medium 4 is conveyed through the medium feed guides 23 into the gap between the air pressurization corrugating mechanism 112 and the lower corrugating roll 2.

The medium feed guides 23 are of a plate-like configuration and are placed to be in an opposed relation to each other in a state where the corrugating medium 4 is interposed therebetween. They have a depth approximately equal to the width-direction length of the corrugating medium 4, and are disposed to connect a guide roller 19 or a feed roller 20 with the air pressurization corrugating mechanism 112 as shown in FIG. 2.

Figure 16:
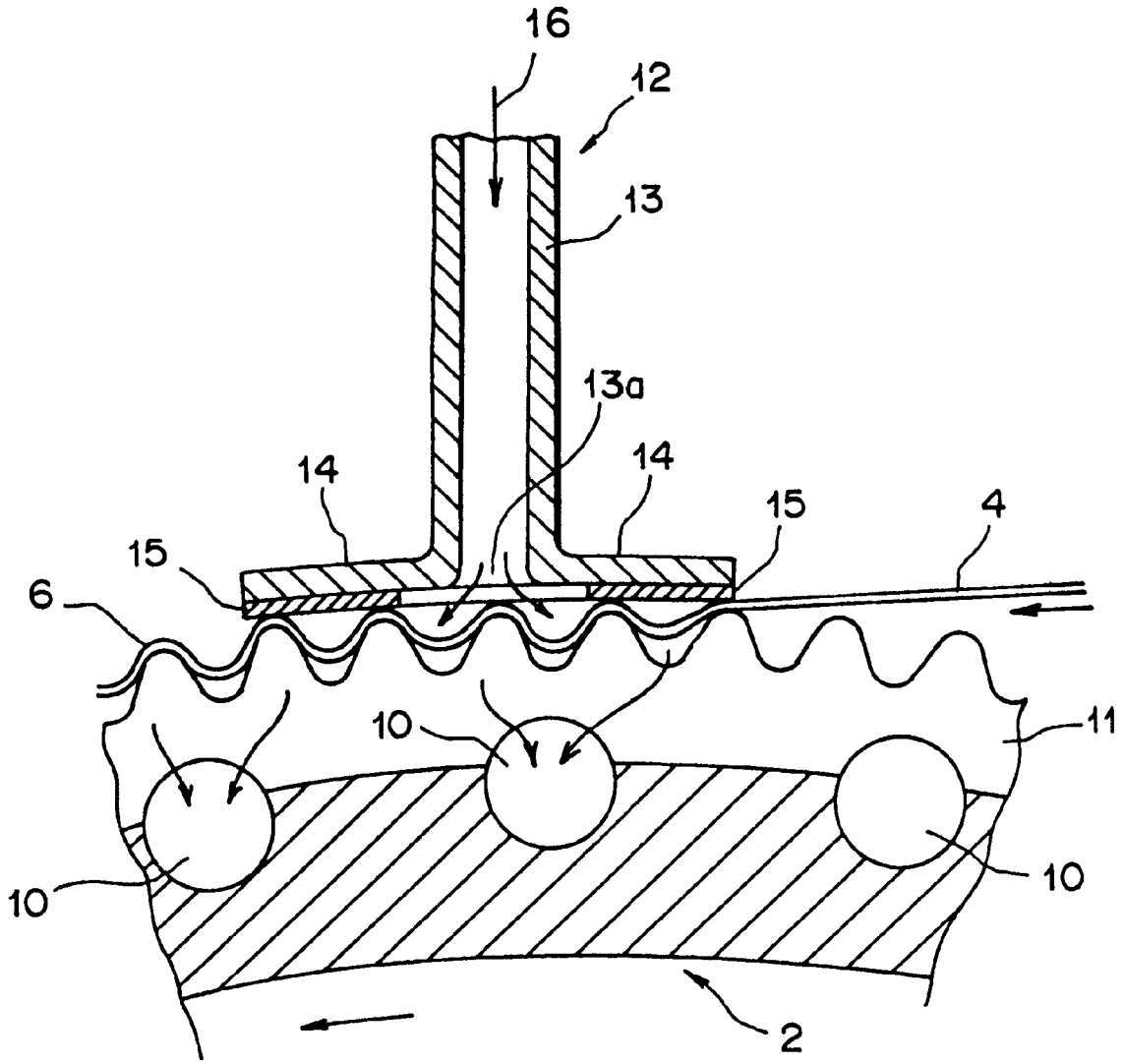
FIG. 16 PRIOR ART
FIG. 16 is an enlarged side-elevational and cross-sectional view showing a principal portion of the different prior single facer.
Figure 17A:
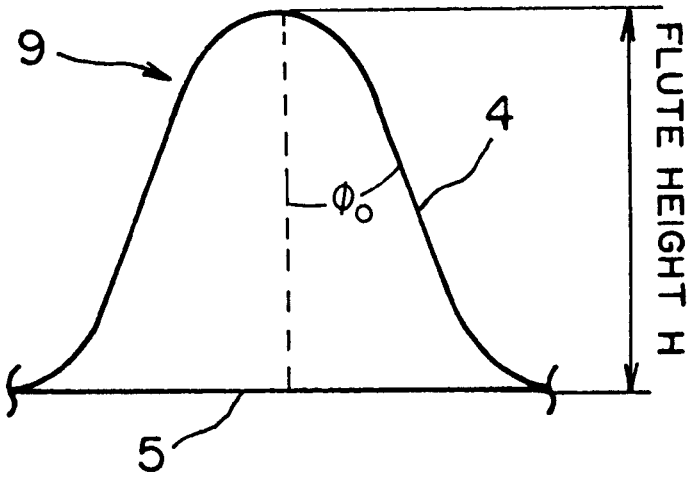
FIG. 17A PRIOR ART
FIGS. 17A and 17B are illustrations of single faced corrugated fiberboard sheets produced by the single facers shown in FIG. 12 and FIG. 14, respectively.
Figure 17B:
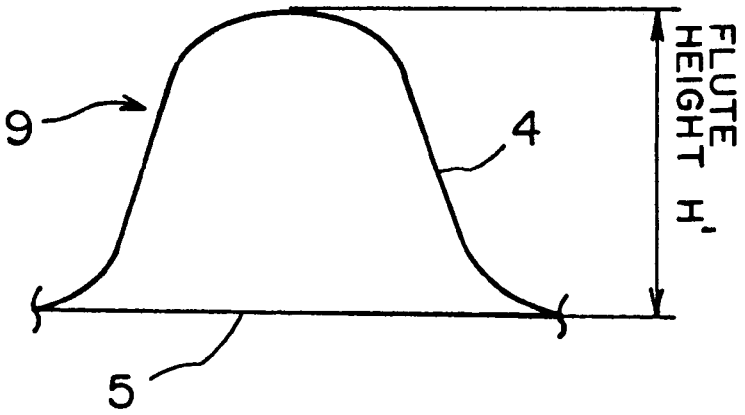
FIG. 17B PRIOR ART

Furthermore, the medium feed guides 23 are placed to make a given angle $\theta$[$\theta$ approximately equals $90-\theta_0$($\theta_0$= pressure angle of flutes of the lower corrugating roll 2)] with respect to a tangential line to the lower corrugating roll 2, and when the corrugating medium 4 is guided by the medium feed guides 23 to be fed into the gap between the air pressurization corrugating mechanism 112 and the lower corrugating roll 2, the corrugating medium 4 is conveyed along a tooth surface of a flute on the circumferential surface of the lower corrugating roll 2 up to an inter-flute bottom. Thus, in the case of the air pressurization corrugating mechanism 112 of this embodiment, as compared with the prior single facer 210 where the corrugating medium 4 is fed from a tangent direction (see FIG. 16), the corrugating medium 4 can smoothly reach the inter-flute bottom portion of the lower corrugating roll 2, and further, the corrugating medium 4 passing through the gap between the guide roller 19 and the feed roller 20 can be put into the gap between the lower corrugating roll 2 and the air pressurization corrugating mechanism 112 in a flat condition without deforming.

This air pressurization corrugating mechanism 112 is disposed on the upstream side of the gluing roll 7 along the outer circumference of the lower corrugating roll 2 to define a gap corresponding to the thickness of the corrugating medium 4 with respect to the flute tip portion of the lower corrugating roll 2, and in a manner that the corrugating medium 4 is put between the sealing member 115 of the air pressurization corrugating mechanism 112 and the flute tip portions of the lower corrugating roll 2, the air leakage from the space between the nozzle body 113 and the front side (one side of the corrugating medium 4 which does not face the lower corrugating roll 2) surface of the corrugating medium 4 is relatively little, so that an airtight condition is substantially maintainable. Further, when the high-pressure air 16 is supplied from a non-shown air supply unit to the interior of the nozzle body 113, the space between the nozzle body 113 and the front side surface of the corrugating medium 4 is maintainable in a high-pressure atmosphere, so that a high static pressure can work on the front side surface of the corrugating medium 4.

In addition, the single facer 100 according to this embodiment is equipped with a humidifying and heating unit 30*a* for humidifying and heating the corrugating medium 4. This humidifying and heating unit 30*a* comprises shower units 17 serving as a humidifying unit and a pair of upper and lower heating rolls 18, 18 acting as a heating unit, being disposed on the upstream side of the medium feed guides 23 of the air pressurization corrugating mechanism 112.

The shower units 17 are located throughout the entire corrugating medium 4 in its width direction on the downstream side of the medium feed guides 23 to be in an opposed relation to each other in a state where the corrugating medium 4 is interposed therebetween, and are made to spout water 28 toward the front and rear surfaces of the corrugating medium 4 to accomplish the humidification thereof.

Furthermore, the pair of upper and lower heating rolls 18, 18 have an axial length substantially equal to the width of the corrugating medium 4, and are situated in directions perpendicular to the traveling direction of the corrugating medium 4 on the upstream side of the medium feed guides 23 but on the downstream side of the shower units 17 to be in an opposed relation to each other in a state where the corrugating medium 4 is put therebetween. These heating rolls 18, 18 have roll sections to be heated by a non-shown heater or the like to a high temperature (for example, above 90° C.), and are rotationally driven in accordance with the traveling of the corrugating medium 4 while holding and pressing, thereby heating the corrugating medium 4.

In this embodiment, the humidifying and heating unit 30*a* conducts the heating and humidifying process so that, for example, the temperature of the corrugating medium 4 reaches 60 to 90° C. and the moisture thereof reaches approximately 6 to 9%. This refining condition is set to enhance the plastic deformability of the corrugating medium 4 and further to reduce the shaping force.

On the basis of the results of element tests, a description will be made hereinbelow of the fact that the humidification (the moisture is at approximately 6 to 9%) and heating (60 to 90° C.) of the corrugating medium 4 reduce the shaping force and enhance the plastic deformability as compared with the case of no humidification nor heating, only heating, and only humidification for the corrugating medium 4.

Figure 3:
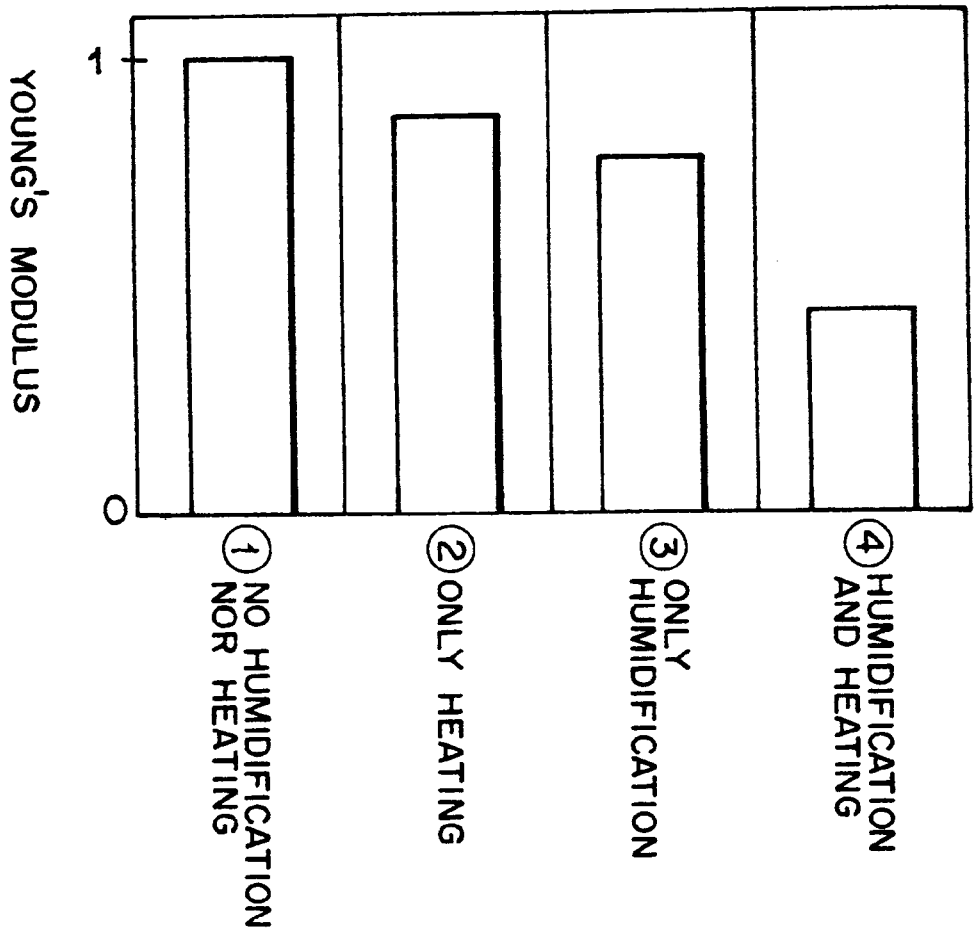
FIG. 3 is an illustration useful for explaining the difference in Young's modulus depending upon the refining condition on a corrugating medium.

FIG. 3 is an illustration useful for explaining the difference in Young's modulus depending upon the refining condition on the corrugating medium 4. For the Young's modulus, a tension test is done in terms of each of the cases of: (1) no humidification nor heating for the corrugating medium 4; (2) only heating therefor; (3) only humidification therefor; and (4) humidification and heating therefor. FIG. 3 shows the Young's modulus in the cases (2) to (4) on the assumption that the Young's modulus in the case (1) is at 1.

As shown in FIG. 3, in the case (4) of humidification and heating for the corrugating medium 4, the Young's modulus becomes the smallest as compared with the case (1) of no humidification nor heating, the case (2) of only heating, and the case (3) of only humidification. This signifies that the case (4) can reduce the force required for the corrugation of the corrugating medium 4.

Figure 4A:
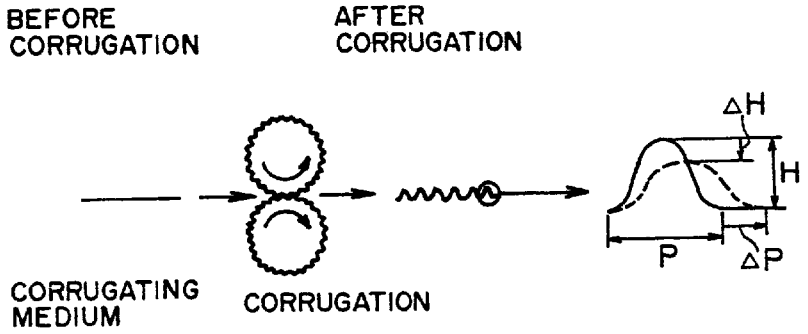
FIGS. 4A to 4C are illustrations for describing the difference in variation of a flute configuration depending upon the refining condition.
Figure 4B:
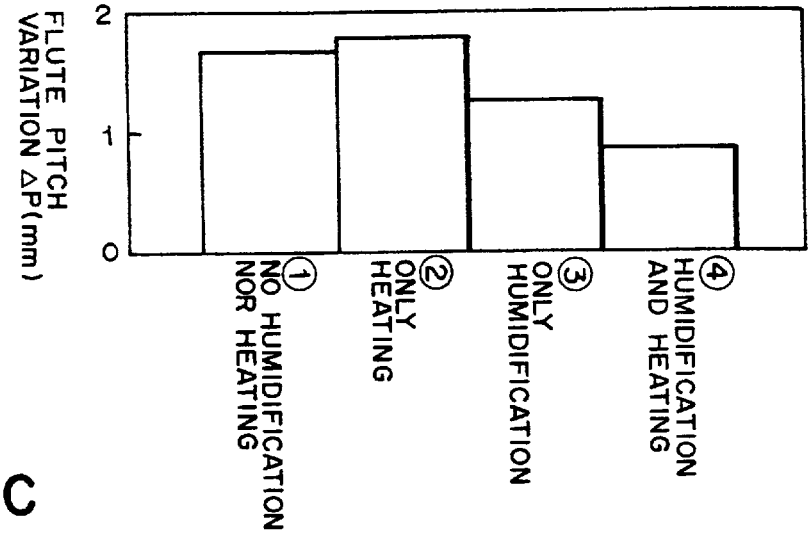
Figure 4C:
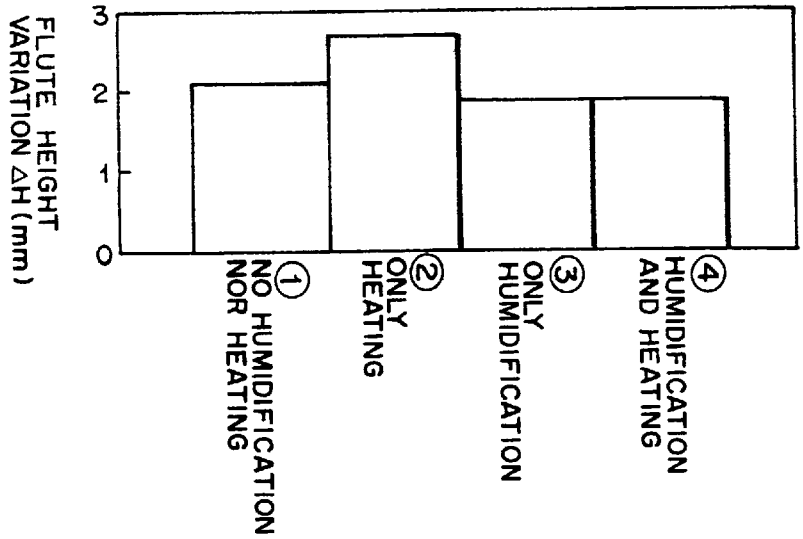

Furthermore, FIGS. 4A to 4C are illustrations for describing the difference in variation of the flute configuration depending upon the refining condition on the corrugating medium 4. FIG. 4A is an illustration for explaining the variation ΔP, ΔH of the flute configuration, and FIGS. 4B and 4C show the measurement results of the flute pitch variation ΔP and the flute height variation AH when the corrugation is made by the corrugating rolls in terms of each of the cases of: (1) no humidification nor heating for the corrugating medium 4; (2) only heating therefor; (3) only humidification therefor; and (4) humidification and heating therefor. As shown in FIG. 4A, the plastic deformability increases to improve the retention of the flute configuration as the both flute pitch variation ΔP and flute height variation ΔH become smaller, which can maintain the flute configuration immediately after the corrugation.

As shown in FIGS. 4B and 4C, because of the largest plastic deformability and excellent flute configuration retention, the case (4) of humidification and heating for the corrugating medium 4 can keep the flute configuration immediately after the corrugation as compared with the case (1) of no humidification nor heating, the case (2) of only heating, and the case (3) of only humidification.

Moreover, the single facer 100 according to this embodiment is provided with a feed mechanism 31 for supplying the corrugating medium 4, processed by the humidifying and heating unit 30*a*, to the air pressurization corrugating mechanism 112 at a given speed, and this feed mechanism 31 comprises a feed roller 20, a guide roller 19, a feed roller rotating motor 21, a feed roller controller 22, a lower corrugating roll rotating motor 21' and a lower corrugating roll controller 22'.

The feed roller 20 has an axial length approximately equal to the width of the corrugating medium 4 is disposed on the downstream side of the humidifying units 17 and the heating rolls 18 but on the upstream side of the air pressurization corrugating mechanism 112 to hold and press the corrugating medium 4 together with the guide roller 19 placed in parallel to the feed roller 20, with the feed roller 20 and the guide roller 19 are made to synchronously rotate in a state where the corrugating medium 4 is put therebetween.

Furthermore, in the conveying path for the corrugating medium 4, a guide roller 19*a* is located at a position where the direction (angle) of the conveying path changes, and the guide roller 19*a* guides the corrugating medium 4, and changes the conveying direction (angle) at the conveyance.

The feed roller rotating motor 21 is for rotationally driving the feed roller 20, while the feed roller controller 22 is for controlling the operation of the feed roller rotating motor 21 to control the rotational speed of the feed roller 20.

On the other hand, the lower corrugating roll rotating motor 21' rotationally drives the lower corrugating roll 2, while the lower corrugating roll controller 22' controls the operation of the lower corrugating roll rotating motor 21' and further transmits rotational speed information about the lower corrugating roll 2 to the feed roller controller 22.

Figures 5, 5A:
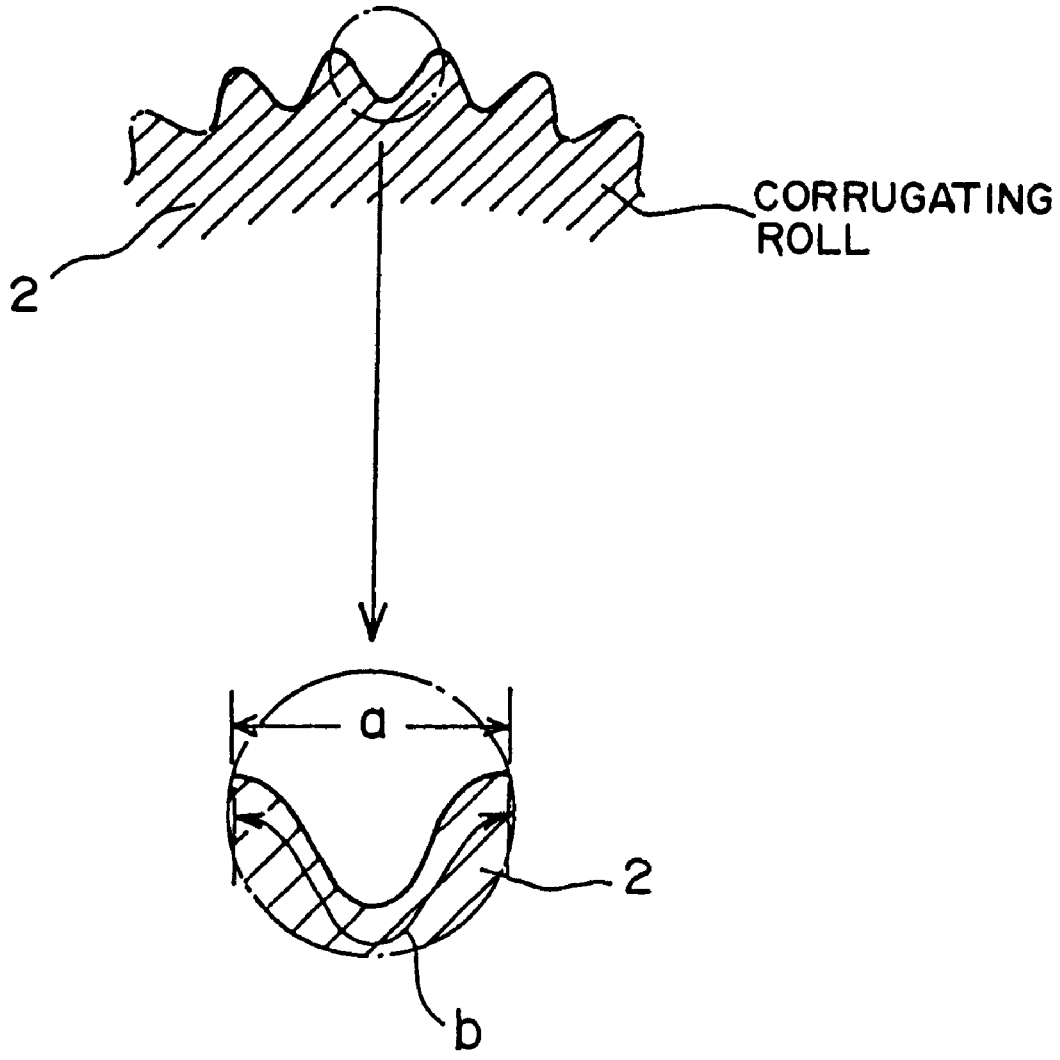
FIG. 5 is an enlarged side-elevational and cross-sectional view showing a portion of a lower corrugating roll for explaining a take up ratio.

FIG. 5 is an enlarged side-elevational cross-sectional view showing a portion of the lower corrugating roll 2 for describing the take up ratio. The feed roller controller 22 calculates the take up ratio [(the circumferential length (b) along flutes corresponding to one pitch in the lower corrugating roll 2)÷(the circumferential length (a) between flute tip portions corresponding to one pitch in the lower corrugating roll 2); see FIG. 5], and controls the feed roller motor 21 on the basis of the rotational speed information about the lower corrugating roll 2 transmitted from the lower corrugating roll controller 22' so that the feed roller 20 is rotated at a rotational speed increased by take up ratio times the rotational speed of the lower corrugating roll 2.

That is, the rotational speed of the feed roller 20 is set to [(the rotational speed of the lower corrugating roll 2)×(the take up ratio)] with respect to the rotational speed of the lower corrugating roll 2 so that the corrugating medium 4 is sent to the corrugating section at a speed of [(the rotational speed of the lower corrugating roll 2)×(the take up ratio)], and therefore, the rear side (the side facing the circumferential surface of the lower corrugating roll 2) surface of the corrugating medium 4 can reach the inter-flute bottom of the lower corrugating roll 2, and the corrugating medium 4 is corrugated into a configuration substantially equal to the flute configuration of the lower corrugating roll 2.

Since the single facer 100 according to the embodiment of this invention is constructed as described above, while the corrugating medium 4 is conveyed through the feed roller 20, the water 28 is first spouted to the front and rear surfaces thereof by the shower units 17 of the humidifying and heating unit 30*a* to conduct the humidification so that its moisture reaches approximately 6 to 9%, and subsequently, in a manner of passing through the gap between the heating rolls 18, the corrugating medium 4 is heated so that its temperature reaches 60 to 90° C.

The corrugating medium 4, subjected to the humidification and heating in the humidifying and heating unit 30*a*, is further conveyed by the feed roller 20, and then guided by the medium feed guides 23 of the air pressurization corrugating mechanism 112 to be supplied into the gap between the flute-made circumferential surface of the lower corrugating roll 2 and the air pressurization corrugating mechanism 112 at a given angle θ. As mentioned above, the conveyance speed to be taken for when the corrugating medium 4 is fed by the feed roller 20 is controlled by the feed roller controller 22 and the controller 22' to be increased by the take up ratio times the rotational speed of the lower corrugating roll 2.

When being fed into the gap between the air pressurization corrugating mechanism 112 and the lower corrugating roll 2, in the gap between the sealing plate 114 and sealing member 115 of the air pressurization corrugating mechanism 112 and the flute-made circumferential surface of the lower corrugating roll 2, the corrugating medium 4 is at a stretch pressed against a flute surface of the lower corrugating roll 2 by the high-pressure air 16 coming through the nozzle body 113, thus forming the corrugated medium 6.

Furthermore, on the rear surface side (the side facing the flute-made circumferential surface of the lower corrugating roll 2) of the corrugating medium 4 (corrugated medium 6), the air suction mechanism sucks, through the circumferential slit grooves 11 and the transverse holes 10, the air existing in the gap between the rear surface of the corrugating medium 4 (corrugated medium 6) and the circumferential surface of the lower corrugating roll 2, with the result that the space between the rear surface of the corrugating medium 4 (corrugated medium 6) and the circumferential surface of the lower corrugating roll 2 always goes into a negative pressure condition to assist the corrugation of the corrugating medium 4 by the compressed air 16 jetted from the air pressurization corrugating mechanism 112 and further to make the formed corrugated medium 6 attractively brought closely into contact with the flute surface of the lower corrugating roll 2 so that the spring back which returns the corrugated medium 6 to its original configuration is suppressible after the removal of the stress working on the corrugated medium 6.

Still further, the lower corrugating roll 2, owing to the suction force taking place on its circumferential surface, conveys the corrugated medium 6 to between the lower corrugating roll 2 and the pressure roll 3 while keeping a closely contacting condition.

In the middle of the corrugated medium 6 being conveyed by the lower corrugating roll 2 to between the lower corrugating roll 2 and the pressure roll 3, the gluing roll 7 applies the glue 8 to its flute tip portions in the gap between the gluing roll 7 and the lower corrugating roll 2, and subsequently, the corrugated medium 6 having the applied glue 8 on its flute tip portions is joined (adhered) to the linerboard 5, guided in a different way by the pressure roll 3, while being heated by the non-shown heating unit in the gap between the pressure roll 3 and the lower corrugating roll 2, thereby producing a single faced corrugated fiberboard sheet 9. The single faced corrugated fiberboard sheet 9 produced is shifted to the next process.

As described above, with the single facer 100 according to the embodiment of this invention, in the humidifying and heating unit 30*a*, immediately after moisture is first given to the front and rear surfaces of the corrugating medium 4 by the shower units (humidifying units) 17, the front and rear surfaces of the corrugating medium 4 are heated by the heating rolls 18, with the result that the plastic deformability of the corrugating medium 4 increases to suppress the spring back after the formation of the single faced corrugated fiberboard sheet 9, which makes it possible to manufacture the single faced corrugated fiberboard sheet 9 without deteriorating the shock absorbing ability of the finally produced corrugated fiberboard sheet due to the collapse of the configuration of the corrugated medium 6 by the spring back.

Furthermore, in the humidifying and heating unit 30*a*, since the front and rear surfaces of the corrugating medium 4 are heated by the heating rolls 18 after the moisture is given thereto by the shower units (humidifying units) 17, it is possible to reduce the force for the corrugation of the corrugating medium 4, which permits the reduction of the air pressure by the air pressurization corrugating mechanism 112 at the air-made corrugation.

Still further, according to this single facer 100, when the corrugating medium 4 is fed to the air pressurization corrugating mechanism 112 by the feed roller 20, the feed roller rotating motor 21 and the feed roller controller 22 drive and controls the feed roller 20 so that the rotational speed of the feed roller 20 is increased by the take up ratio [the value obtained by dividing a length of one round along the flutes of the corrugating roll by an outer circumferential length (corresponding to one round) of the corrugating roll] times the rotational speed of the lower corrugating roll 2, with the result that the air pressure required for the air-made corrugation is reducible.

Moreover, according to this single facer 100, the corrugating medium 4 is forwarded by the medium feed guides 23 into the gap between the air pressurization corrugating mechanism 112 and the lower corrugating roll 2 to make a given angle $\theta$[$\theta$ approximately equals $90-\theta_0$ (where $\theta_0$=the pressure angle of the flute of the lower corrugating roll 2)] therebetween, which makes the corrugating medium 4 smoothly reach the inter-flute bottom portion of the lower corrugating roll 2, and which allows the reduction of the air pressure by the air pressurization corrugating mechanism 112 at the air-made corrugation. In addition, it is possible to prevent the corrugating medium 4 from being delayingly fed with respect to the air corrugating speed at the air-made corrugation of the corrugating medium 4 in the air pressurization corrugating mechanism 112 so that the corrugation delay is avoidable, which permits manufacturing the single faced corrugated fiberboard sheet 9 without lowering the flute height of the corrugated medium 6 processed.

(B) Description of a First Modification

Figure 6:
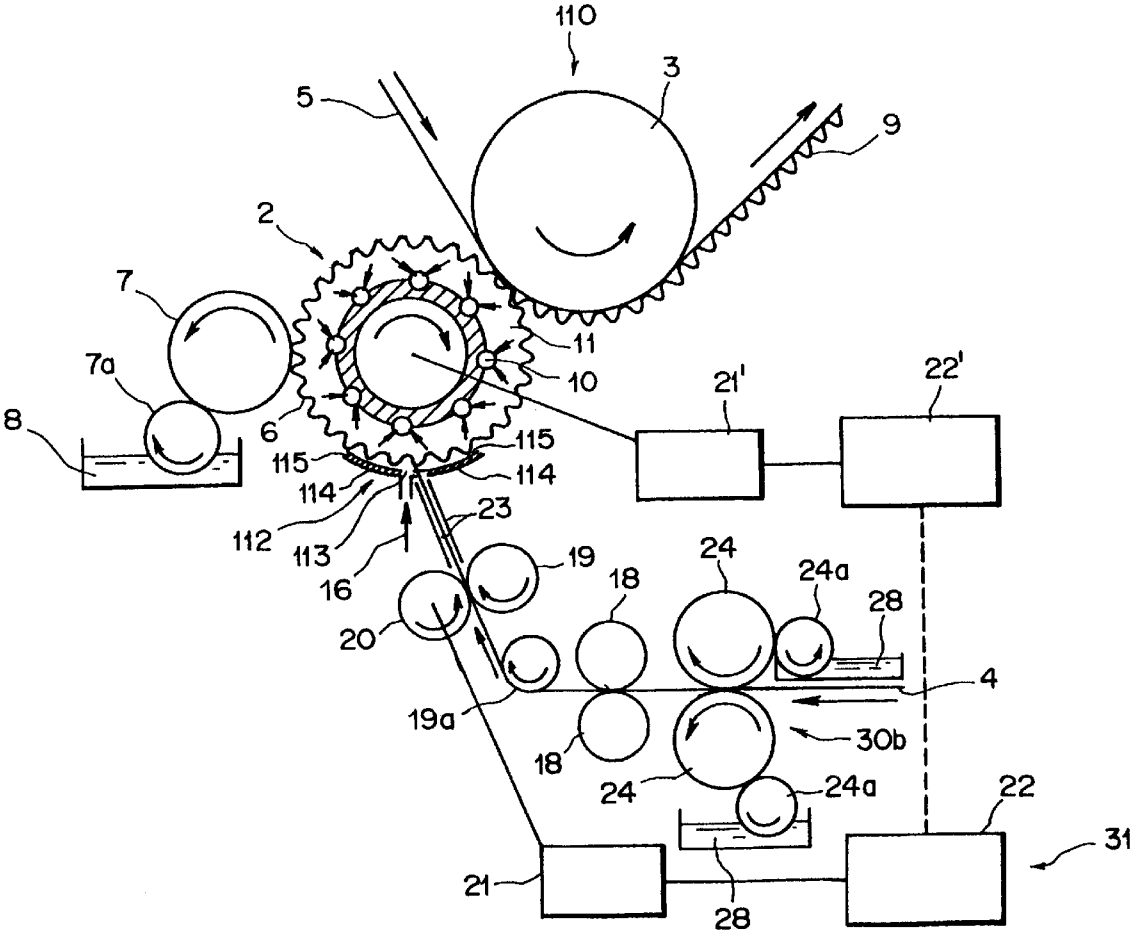
FIG. 6 illustratively shows a construction of a first modification of the single facer according to the embodiment of this invention.

FIG. 6 illustratively shows a construction of a first modification of the single facer according to the embodiment of this invention. As shown in FIG. 6, a single facer 110 according to the first modification has a construction in which a humidifying and heating unit 30*b* is provided in place of the humidifying and heating unit 30*a* in the single facer 100 shown in FIG. 1, and the other parts are substantially similar to those of the single facer 100 shown in FIG. 1. In FIG. 6, the same numerals as those used in the above description designate the same or corresponding parts, and hence, the description thereof will be omitted for brevity.

As shown in FIG. 6, the single facer 110 according to the first modification is also equipped with a lower corrugating roll 2, a gluing roll 7, a pressure roll 3, an air pressurization corrugating mechanism 112 and others, and the structures thereof are the same as those of the single facer 100 shown in FIG. 1.

Figure 7:
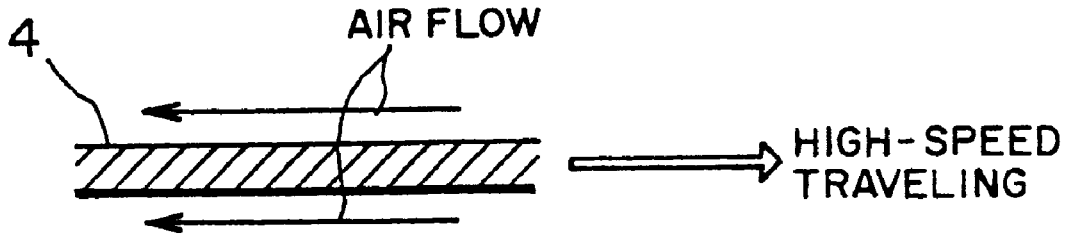
FIG. 7 is a partially enlarged illustration of a corrugating medium.

Although the humidifying and heating unit 30*a* of the single facer 100 shown in FIG. 1 is made to accomplish the humidification for the corrugating medium 4 in a manner that the water 28 is spouted from the shower units 17 to the front and rear surfaces of the corrugating medium 4 traveling at a high speed, in the case of the humidifying process by the shower units 17, as shown in FIG. 7, due to the high-speed traveling of the corrugating medium 4, air flows occur in the vicinity of the front surface of the corrugating medium 4 in directions opposite to the traveling direction of the corrugating medium 4, thus developing a phenomenon which is as if an air curtain takes place on the front surface of the corrugating medium 4.

For this reason, when the water 28 is spouted from the shower units 17 to the corrugating medium 4, because of the air curtain occurring in the vicinity of the front surface of the corrugating medium 4, it becomes hard to attach the moisture onto the corrugating medium 4, and as the conveyance speed of the corrugating medium 4 increases, the influence of the air curtain occurring near the front surface of the corrugating medium 4 further grows, so that there is the possibility of lessening the moisture on the corrugating medium 4.

Thus, in the single facer 110 according to the first modification, the humidifying and heating unit 30*b*, being made up of a pair of upper and lower watering rolls 24, 24 serving as a humidifying unit and a pair of upper and lower heating rolls 18, 18 acting as a heating unit, is disposed on the downstream side of medium feed guides 23 of the air pressurization corrugating mechanism 112.

The pair of upper and lower watering rolls 24, 24 each have an axial length substantially equal to the width of the corrugating medium 4, and are disposed in a direction perpendicular to the traveling direction of the corrugating medium 4 on the downstream side of the medium feed guides 23 to be in an opposed relation to each other to hold and press the corrugating medium 4 therebetween.

Each of the watering rolls 24, 24 evenly holds the water 28 on its entire circumferential surface at all times by rotating while coming into contact with a roll 24*a* dipped in the water 28, and further humidifies the corrugating medium 4 by rotating while coming into contact with the corrugating medium 4.

Furthermore, the pair of upper and lower heating rolls 18, 18, being similar to those of the humidifying and heating unit 30*a* of the single facer 100, are placed on the upstream side of the medium feed guides 23 but on the downstream side of the shower units 17.

Incidentally, similarly, the humidifying and heating unit 30*b* accomplishes the heating and humidification so that, for example, the temperature of the corrugating medium 4 assumes 60 to 90° C. and the moisture thereof takes 6 to 9%.

Since the single facer 110 according to the first modification is constructed as described above, as well as the single facer 100 shown in FIG. 1, the corrugating medium 4 is transferred through the feed roller 20, and in the humidifying and heating unit 30*b*, the corrugating medium 4 is first humidified to obtain a moisture of approximately 6 to 9% in a manner that the water 28 is applied through the watering rollers 24 to the front and rear surfaces thereof, and subsequently, is heated up to a temperature of 60 to 90° C. when passing through the gap between the heating rolls 18.

At this time, the humidification of the corrugating medium 4 by the watering rolls 24, 24 eliminates the influence of the conveyance speed of the corrugating medium 4 and makes an adequate amount of moisture adhere to the corrugating medium 4.

The corrugating medium 4, humidified and heated by the humidifying and heating unit 30*b*, is subsequently shaped into a corrugated medium 6 as well as the above-described single facer 100 and further processed to produce a single faced corrugated fiberboard sheet 9, before advancing to the next process.

As mentioned above, the single facer 110 according to the first modification can provide the same effects as those of the above-described single facer 100, and since the corrugating medium 4 is humidified through the use of the watering rolls 24 in the humidifying and heating unit 30*b*, an appropriate quantity of moisture can be attached onto the corrugating medium 4 irrespective of the conveyance speed of the corrugating medium 4, with the result that it is possible to increase the conveyance speed of the corrugating medium 4 to allow a high-speed operation, thus improving the productivity.

(C) Description of a Second Modification

Figure 8:
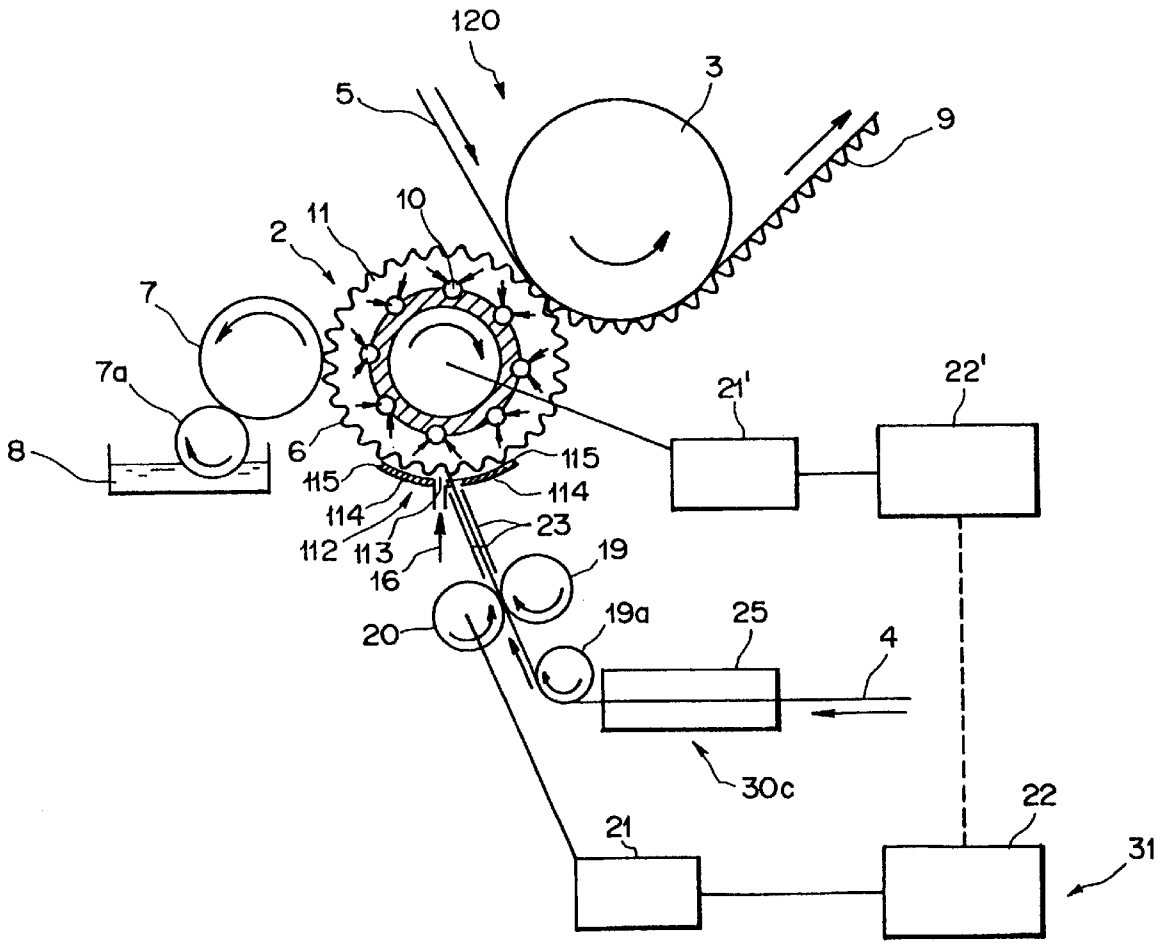
FIG. 8 illustratively shows a construction of a second modification of the single facer according to the embodiment of this invention.

FIG. 8 illustratively shows a construction of a second modification of the single facer according to the embodiment of this invention. As shown in FIG. 8, a single facer 120 according to the second modification has a construction in which a humidifying and heating unit 30*c* is provided in place of the humidifying and heating unit 30*a* in the single facer 100 shown in FIG. 1, and the other parts are similar to those of the single facer 100 shown in FIG. 1. In FIG. 8, the same numerals as those used in the above description signify the same or corresponding parts, and hence, these parts are omitted from the following description.

Likewise, the single facer 120 according to the second modification is, as shown in FIG. 8, equipped with a lower corrugating roll 2, a gluing roll 7, a pressure roll 3, an air pressurization corrugating mechanism 112 and others, and the structures thereof are the same as those of the single facer 100 shown in FIG. 1.

The single facer 120 according to the second modification is provided with a humidifying and heating unit 30*c* comprising a steam unit 25. In this steam unit 25, its internal space is filled with high-temperature steam, and the humidification and heating take place for a corrugating medium 4 passing through the space. Further, in this steam unit 25, the steam adjustment is done so that, for example, the temperature of the corrugating medium 4 immediately after the passage in the steam unit 25 reaches 60 to 90° C. and the moisture thereof comes to approximately 6 to 10%.

Since the single facer 120 according to the second modification 120 is constructed as mentioned above, as well as the single facer 100 shown in FIG. 1, the corrugating medium 4 is conveyed by a feed roller 20 to the steam unit 25 constituting the humidifying and heating unit 30*c* where the humidification and heating are simultaneously conducted so that its moisture reaches approximately 6 to 9% and its temperature assumes 60 to 90° C.

The corrugating medium 4 humidified and heated in the humidifying and heating unit 30*c* is subsequently processed to form a corrugated medium 6 as well as the above-described single facer 100, then producing a single faced corrugated fiberboard sheet 9, before advancing to the next process.

As described above, the single facer 120 according to the second modification can offer the same effects as those of the above-described single facer 100, and further, since the humidification and heating for the corrugating medium 4 can simultaneously be done in the steam unit 25 constituting the humidifying and heating unit 30*c*, there is no need to install a humidifying unit and a heating unit separately, thereby realizing a compact apparatus.

(D) Description of a Third Modification

Figure 9:
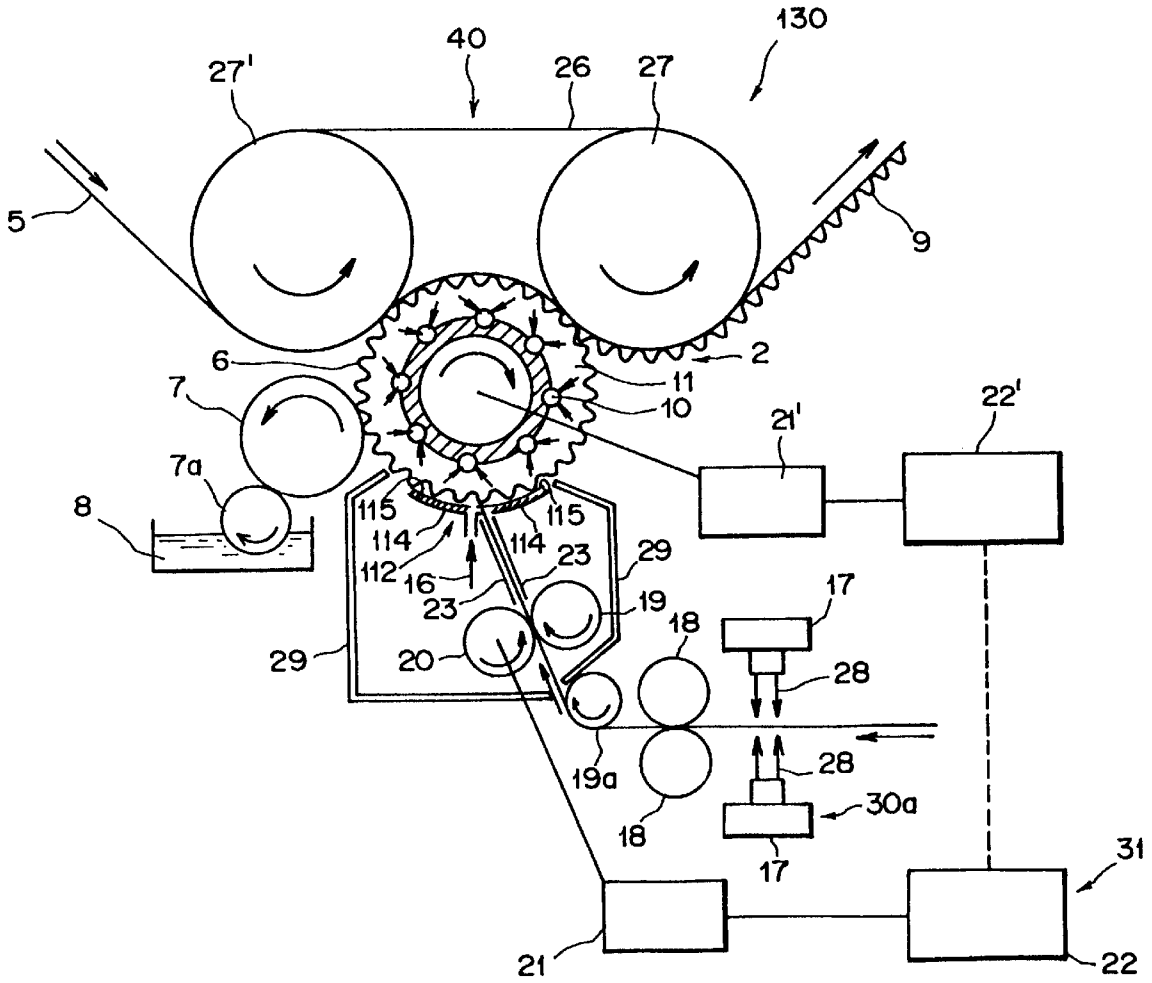
FIG. 9 illustratively shows a construction of a third modification of the single facer according to the embodiment of this invention.

FIG. 9 illustratively shows a construction of a third modification of the single facer according to the embodiment of this invention. As shown in FIG. 9, a single facer 130 according to the third modification has a construction where a belt pressurization mechanism 40 is provided in place of the pressure roll 3 in the single facer 100 shown in FIG. 1 and a partial enclosure (noise intercepting structure) 29 is placed around an air pressurization corrugating mechanism 112 to cover it. The other parts are the same as those of the single facer 100 shown in FIG. 1. In FIG. 9, the same numerals as those used in the above description denote the same or corresponding parts, and these parts are omitted from the following description.

Likewise, the single facer 130 according to the third modification is, as shown in FIG. 9, equipped with a lower corrugating roll 2, a gluing roll 7, an air pressurization corrugating mechanism 112, a humidifying and heating unit 30*a* and others, and the structures thereof are the same as those of the single facer 100 shown in FIG. 1.

As shown in FIG. 9, the single facer 130 according to the third modification is equipped with the belt pressurization mechanism 40 which is constructed by stretching a pressure belt 26 between belt rolls 27, 27' in an endless condition.

In this belt pressurization mechanism 40, its pressure belt 26 is placed to come into contact with the lower corrugating roll 2 on the downstream side of the location of the air pressurization corrugating mechanism 112, and is guided along the outer circumferences of the belt rolls 27, 27' in accordance with the rotation of the lower corrugating roll 2.

Furthermore, the partial enclosure 29 is constructed by a combination of plate-like members made of a soundproof material or the like, and is located around the air pressurization corrugating mechanism 112 to intercept the noises generated by the air pressurization corrugating mechanism 112 at the corrugation.

Since the single facer 130 according to the third modification is constructed as mentioned above, the corrugating medium 4 is conveyed by a feed roller 20 to the humidifying and heating unit 30*a* where water 28 is first spouted by shower units 17 toward the front and rear surfaces of the corrugating medium 4 for humidification so that its moisture reaches 6 to 9%, and subsequently, the heating is done in a manner that the corrugating medium 4 passes through the gaps between heating rolls 18, which makes its temperature come to 60 to 90° C.

The corrugating medium 4, being humidified and heated in the humidifying and heating unit 30*a*, is further conveyed by the feed roller 20 to be guided by medium feed guides 23 of the air pressurization corrugating mechanism 112, and is corrugated between the flute-made surface of the lower corrugating roll 2 and the air pressurization corrugating mechanism 112 into a corrugated medium 6.

Furthermore, owing to the suction force occurring on the circumferential surface of the lower corrugating roll 2, the corrugated medium 6 is transferred in a state of being maintained in a closely contacting condition with the circumferential surface of the lower corrugating roll 2 against a centrifugal force thereof, and after a glue 8 is applied onto its flute tip portions by the gluing roll 7 in the gap between the gluing roll 7 and the lower corrugating roll 2, the corrugating medium 4 is further conveyed into the gap between the lower corrugating roll 2 and the belt pressurization mechanism 40.

In the gap between the lower corrugating roll 2 and the belt pressurization mechanism 40, the corrugated medium 6 having the glue 8 on its flute tip portions is joined (adhered) to a linerboard 5, guided in a different way by the belt pressurization mechanism 40, under pressure while being heated by a non-shown heating unit, thereby producing a single faced corrugated fiberboard sheet 9. The single faced corrugated fiberboard sheet 9 produced is shifted to the next process.

As described above, the single facer 130 according to the third modification can provide the same effects as those of the above-described single facer 100, and further, since the air pressurization corrugating mechanism 112 is covered with the partial enclosure 29, the noise occurring at the corrugation is reducible, and since the adhesion between the corrugated medium 6 and the linerboard 5 is achieved between the pressure belt 26 with a resiliency and the lower corrugating roll 2, the noise to be generated at the adhesion is remarkably reducible, and it is possible to prevent the occurrence of the press mark on the single faced corrugated fiberboard sheet 9 on the side of the linerboard 5 resulting from the pressing force of the lower corrugating roll 2, with the result that a high-quality single faced corrugated fiberboard sheet 9 is producible.

(E) Description of a Fourth Modification

Figure 10:
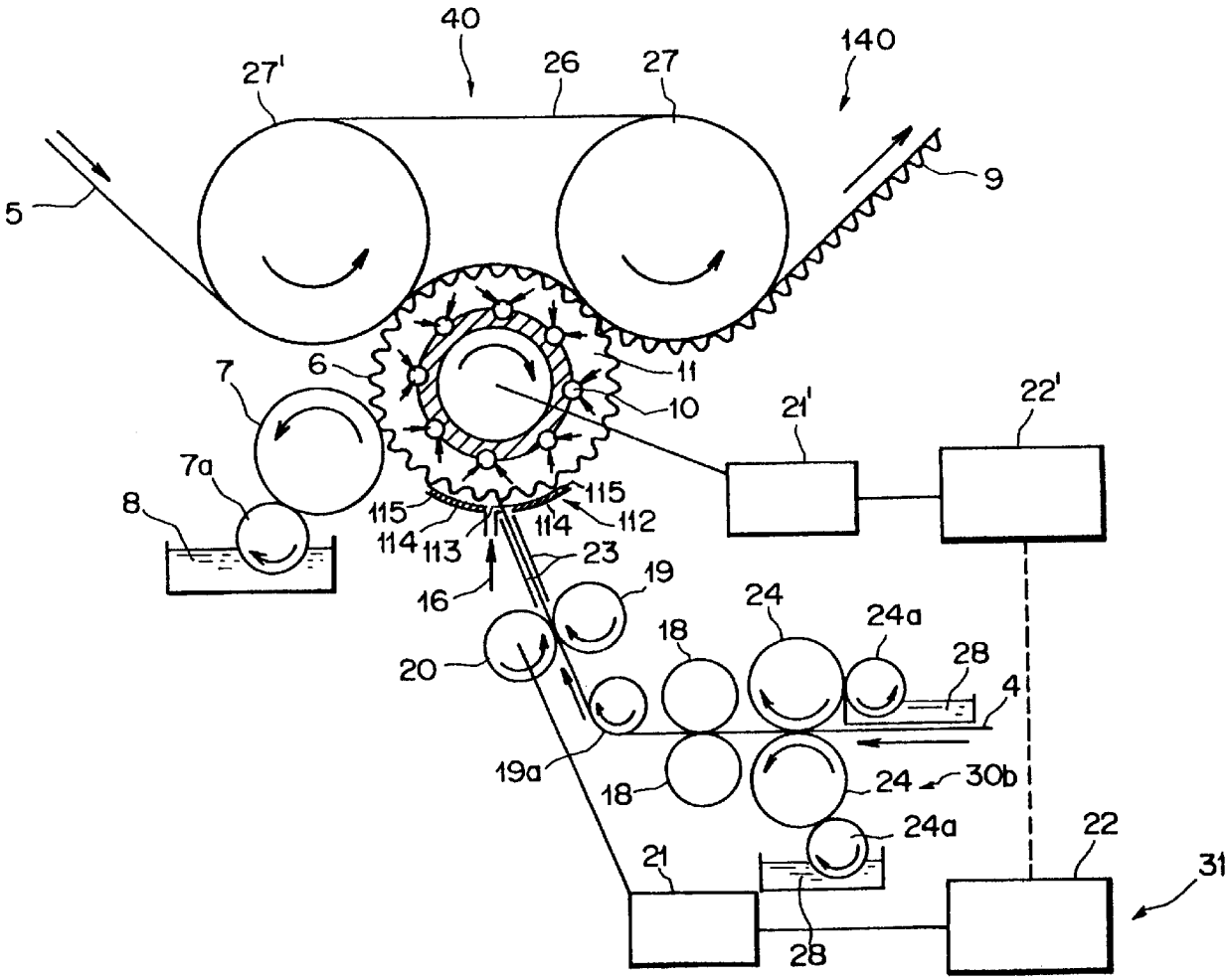
FIG. 10 illustratively shows a construction of a fourth modification of the single facer according to the embodiment of this invention.

FIG. 10 illustratively shows a construction of a fourth modification of the single facer according to the embodiment of this invention. As shown in FIG. 10, a single facer 140 according to the fourth modification has a construction in which a belt pressurization mechanism 40 is used instead of the pressure roll 3 in the single facer 110 shown in FIG. 6, and the other parts thereof are the same as those of the single facer 110 shown in FIG. 6. In FIG. 10, the same numerals as those used in the above description depict the same or corresponding parts, and these parts are omitted from the following description.

Similarly, the single facer 140 according to the fourth modification is, as shown in FIG. 10, equipped with a lower corrugating roll 2, a gluing roll 7, an air pressurization corrugating mechanism 112, a humidifying and heating unit 30*b* and others, and the structures thereof are substantially the same as those of the single facer 100 shown in FIG. 1. In addition, this single facer 140 further includes a belt pressurization mechanism 40 like the single facer 130 shown in FIG. 9, with this belt pressurization mechanism 40 having the same structure as that of the single facer 130.

Since the single facer 140 according to the fourth modification has a construction mentioned above, a corrugating medium 4 is conveyed by a feed roller 20 to the humidifying and heating unit 30*b* where water 28 is first applied by watering rolls 24 onto the front and rear surfaces of the corrugating medium 4 to accomplish the humidification so that its moisture reaches 6 to 9%, and subsequently, the corrugating medium 4 passes through the gap between heating rolls 18 to be heated so that its temperature assumes 60 to 90° C.

The corrugating medium 4, humidified and heated in the humidifying and heating unit 30*b*, is shaped into a corrugated medium 6 which in turn, is processed between the belt pressurization mechanism 40 and the lower corrugating roll 2 to produce a single faced corrugated fiberboard sheet 9, before advancing to the next process.

As described above, with the single facer 140 according to the fourth modification, it is possible to provide the same effects as those of the above-described single facer 100, and further, since the adhesion between the corrugated medium 6 and the linerboard 5 is achieved between the pressure belt 26 with a resiliency and the lower corrugating roll 2, the noise to be generated at the adhesion is remarkably reducible, and it is possible to prevent the occurrence of the press mark on the single faced corrugated fiberboard sheet 9 on the side of the linerboard 5 resulting from the pressing force of the corrugating roll 2, with the result that a high-quality single faced corrugated fiberboard sheet 9 is producible. Moreover, since the corrugating medium 4 is humidified through the use of the watering rolls 24 in the humidifying and heating unit 30*b*, an adequate amount of moisture can be applied onto the corrugating medium 4 irrespective of the conveyance speed of the corrugating medium 4, which allows the increase in the conveyance speed of the corrugating medium to permit a high-speed operation, so that the productivity is improvable.

(F) Description of a Fifth Modification

Figure 11:
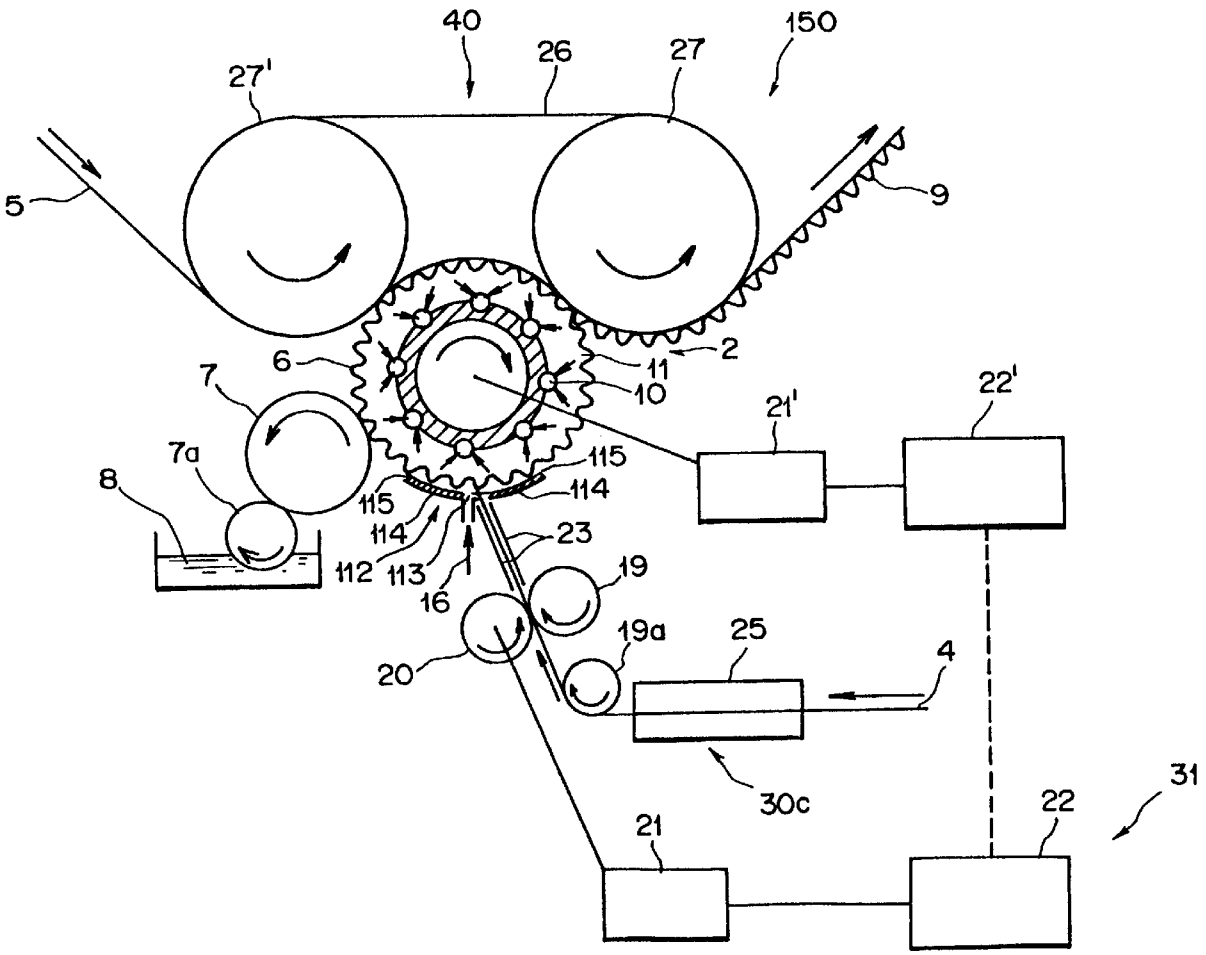
FIG. 11 illustratively shows a construction of a fifth modification of the single facer according to the embodiment of this invention.
Figure 12:
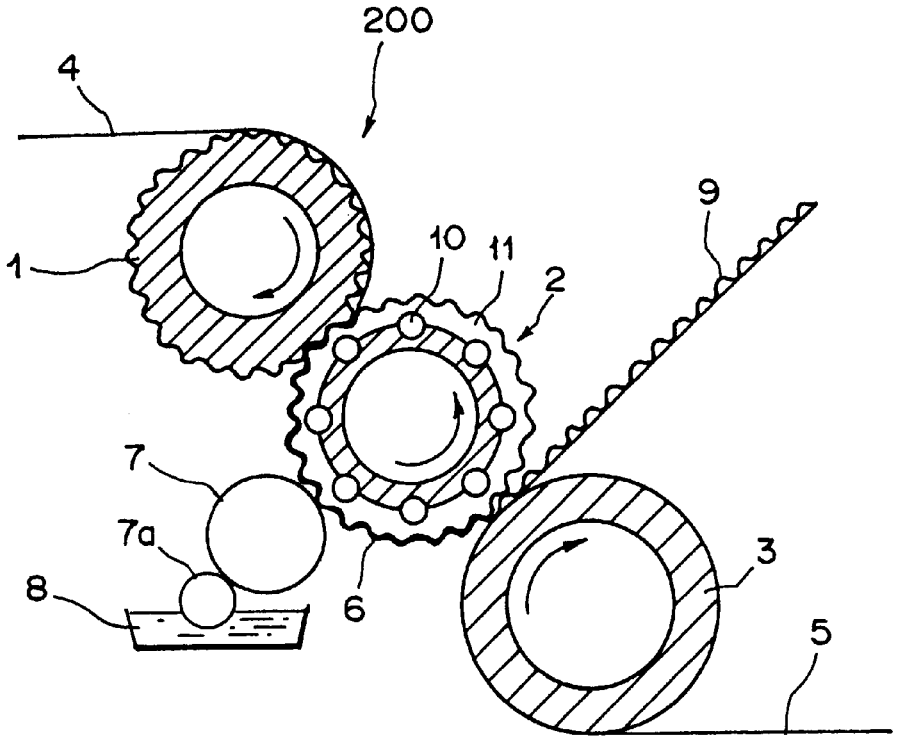
FIG. 12 PRIOR ART
FIG. 12 is a side-elevational and cross-sectional view illustratively showing a construction of a prior single facer.
Figure 13:
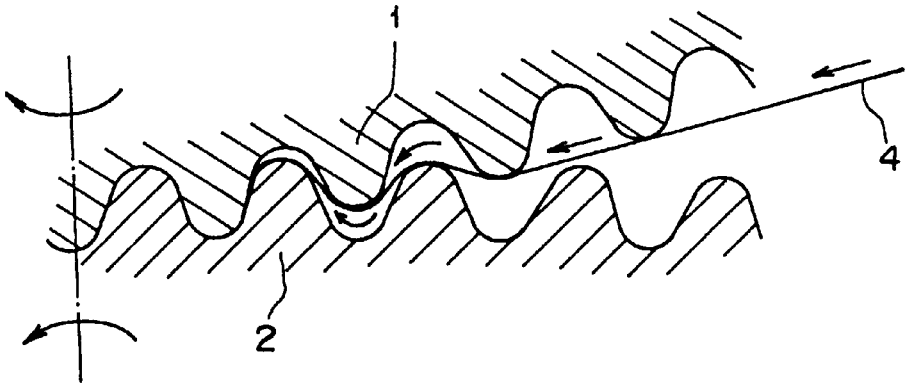
FIG. 13 PRIOR ART
FIG. 13 is an enlarged view showing a principal portion of the prior single facer shown in FIG. 12.

FIG. 11 illustratively shows a construction of a fifth modification of the single facer according to the embodiment of this invention. As shown in FIG. 11, a single facer has a construction where a belt pressurization mechanism 40 is used in place of the pressure roll 3 in the single facer 120 shown in FIG. 8, and the other parts thereof are the same as those of the single facer 100 shown in FIG. 1. In FIG. 11, the same numerals as those used in the above description signify the same or corresponding parts, and the description thereof will be omitted for brevity.

Similarly, the single facer 150 according to the fifth modification is, as shown in FIG. 11, equipped with a lower corrugating roll 2, a gluing roll 7, an air pressurization corrugating mechanism 112, a humidifying and heating unit 30*c* and others, and these has the same structures as those of the single facer 120 shown in FIG. 8. In addition, this single facer 150 has a belt pressurization mechanism 40 like the single facer 130 shown in FIG. 9, with the belt pressurization mechanism 40 having the same structure as that of the single facer 130.

Since the single facer 150 according to the fifth modification has a construction mentioned above, as well as the single facer 120, a corrugating medium 4 is conveyed by a feed roller 20 to a steam unit 25 constituting the humidifying and heating unit 30*c* where the humidification and heating are simultaneously done so that its moisture reaches approximately 6 to 9% and its temperature assumes 60 to 90° C.

Like the above-described fourth modification, the corrugating medium 4, humidified and heated in the humidifying and heating unit 30*c*, is shaped into a corrugated medium 6 which in turn, is processed between the belt pressurization mechanism 40 and the lower corrugating roll 2 to produce a single faced corrugated fiberboard sheet 9, before advancing to the next process.

As described above, with the single facer 150 according to the fifth modification, it is possible to provide the same effects as those of the above-described single facer 100, and further, since the adhesion between the corrugated medium 6 and the linerboard 5 is achieved between the pressure belt 26 with a resiliency and the lower corrugating roll 2, the noise to be generated at the adhesion is remarkably reducible, and it is possible to prevent the occurrence of the press mark on single faced corrugated fiberboard sheet 9 on the side of the linerboard 5 resulting from the pressing force of the corrugating roll 2, with the result that a high-quality single faced corrugated fiberboard sheet 9 is producible. Moreover, since both the humidification and heating for the corrugating medium 4 are simultaneously achievable with the steam unit 25 composing the humidifying and heating unit 30*c*, there is no need to provide a humidifying unit and a heating unit separately, which allows a compact apparatus.

(G) Others

Although in the above-described embodiment the air jetting opening 113*a* of the nozzle body 113 of the air pressurization corrugating mechanism 112 is constructed such that its slit extending over the axial overall length of the lower corrugating roll 2 is divided into a plurality of sections each having an elongated quadrangular configuration, this invention is not limited to this, and it is also possible that the air jetting opening 113*a* (transverse cross-sectional configuration) of the nozzle body 113 of the air pressurization corrugating mechanism 112 is constructed as a single slit having a long side substantially equal to the axial length of the lower corrugating roll 2 and a short side slightly longer than the flute pitch of the lower corrugating roll 2, and that the transverse cross-sectional configuration of the air jetting opening 113*a* of the nozzle body 113 is an ellipse or a circle.

Besides, although the above-described single facer 130 is equipped with the partial enclosure 29, this invention is not limited to this, and it is also appropriate that the other modifications include the partial enclosure 29.

What is claimed is:

1. A single facer comprising, a corrugating roll for corrugation-processing a corrugating medium;

an air pressurization corrugating mechanism for applying an air pressure to said corrugating medium to press said corrugating medium against said corrugating roll;

a pressing mechanism for pressing a linerboard, fed in a different way, against said corrugating medium corrugated by said air pressurization corrugating mechanism and said corrugating roll for adhesion therebetween, thereby producing a single faced corrugated fiberboard sheet;

a humidifying and heating unit placed on the upstream side of said air pressurization corrugating mechanism for humidifying and heating said corrugating medium as a humidification and heating process;

a feed mechanism for feeding said corrugating medium, processed by said humidifying and heating unit, to said air pressurization corrugating mechanism at a given speed; and a medium feed guide for guiding said corrugating medium toward the circumferential surface of said corrugating roll in such a manner that said corrugating medium defines, with respect to a tangential line of said corrugating roll, an angle θ when said corrugating medium is supplied into a gap between said air pressurization corrugating mechanism and said corrugating roll, said angle θ being complementary to a pressure angle of teeth of said corrugating roll with respect to a right angle subtending said tangential line and a line that extends radially outwardly of said corrugating roll and perpendicularly to said tangential line.

2. A single facer comprising a corrugating roll for corrugation-processing a corrugating medium;

an air pressurization corrugating mechanism for applying an air pressure to said corrugating medium to press said corrugating medium against said corrugating roll;

a pressing mechanism for pressing a linerboard, fed in a different way, against said corrugating medium corrugated by said air pressurization corrugating mechanism and said corrugating roll for adhesion therebetween, thereby producing a single faced corrugated fiberboard sheet;

a humidifying and heating unit placed on the upstream side of said air pressurization corrugating mechanism for humidifying and heating said corrugating medium as a humidification and heating process;

a feed mechanism for feeding said corrugating medium, processed by said humidifying and heating unit, to said air pressurization corrugating mechanism at a given speed;

an air suction mechanism for sucking air between said corrugating roll and said corrugating medium so that said corrugating medium is drawn to a circumferential surface of said corrugating roll; and a medium feed guide for guiding said corrugating medium toward the circumferential surface of said corrugating roll in such a manner that said corrugating medium defines, with respect to a tangential line of said corrugating roll, an angle θ when said corrugating medium is supplied into a gap between said air pressurization corrugating mechanism and said corrugating roll, said angle θ being complementary to a pressure angle of teeth of said corrugating roll with respect to a right angle subtending said tangential line and a line that extends radially outwardly of said corrugating roll and perpendicularly to said tangential line.

3. A single facer as defined in claim 1, wherein said feed mechanism comprises:

a feed roller which rotates in a state of coming into contact with said corrugating medium to forward said corrugating medium into said air pressurization corrugating mechanism at said given speed;

a feed roller rotating motor for rotationally driving said feed roller;

a feed roller controller for controlling an operation of said feed roller rotating motor to control a rotational speed of said feed roller;

a corrugating roll rotating motor for rotationally driving said corrugating roll; and a corrugating roll controller for controlling an operation of said corrugating roll rotating motor to control a rotational speed of said corrugating roll, wherein said corrugating roll controller transmits information indicative of said rotational speed of said corrugating roll to said feed roller controller, while said feed roller controller controls said feed roller rotating motor so that said feed roller is rotated at a rotational speed obtained by multiplying said rotational speed transmitted from said corrugating roll controller by a take up ratio of said corrugating roll.

4. A single facer as defined in claim 2, wherein said feed mechanism comprises:

a feed roller which rotates in a state of coming into contact with said corrugating medium to forward said corrugating medium into said air pressurization corrugating mechanism at said given speed;

a feed roller rotating motor for rotationally driving said feed roller;

a feed roller controller for controlling an operation of said feed roller rotating motor to control a rotational speed of said feed roller;

a corrugating roll rotating motor for rotationally driving said corrugating roll; and a corrugating roll controller for controlling an operation of said corrugating roll rotating motor to control a rotational speed of said corrugating roll, wherein said corrugating roll controller transmits information indicative of said rotational speed of said corrugating roll to said feed roller controller, while said feed roller controller controls said feed roller rotating motor so that said feed roller is rotated at a rotational speed obtained by multiplying said rotational speed transmitted from said corrugating roll controller by a take up ratio of said corrugating roll.

5. A single facer as defined in claim 2, wherein said pressing mechanism is constructed as a belt pressurization mechanism including an endless pressure belt for pressing said linerboard to the corrugating roll side in a state where said corrugating medium corrugation-processed is interposed between said linerboard and said corrugating roll.

6. A single facer as defined in claim 2, further comprising a noise intercepting structure located around said air pressurization corrugating mechanism for intercepting noises generated by said air pressurization corrugating mechanism.

7. A single facer as defined in claim 1, wherein said humidifying and heating unit comprises a shower unit for spouting water to said corrugating medium for said humidification process and a heating roll for heating said corrugating medium by rotating while coming into contact with said corrugating medium for said heating process.

8. A single facer as defined in claim 3, wherein said humidifying and heating unit comprises a shower unit for spouting water to said corrugating medium for said humidification process and a heating roll for heating said corrugating medium by rotating while coming into contact with said corrugating medium for said heating process.

9. A single facer as defined in claim 2, wherein said humidifying and heating unit comprises a shower unit for spouting water to said corrugating medium for said humidification process and a heating roll for heating said corrugating medium by rotating while coming into contact with said corrugating medium for said heating process.

10. A single facer as defined in claim 1, wherein said humidifying and heating unit comprises a watering roll for applying water to said corrugating medium by rotating in a state of coming into contact with said corrugating medium for said humidification process and a heating roll for heating said corrugating medium by rotating while coming into contact with said corrugating medium for said heating process.

11. A single facer as defined in claim 3, wherein said humidifying and heating unit comprises a watering roll for applying water to said corrugating medium by rotating in a state of coming into contact with said corrugating medium for said humidification process and a heating roll for heating said corrugating medium by rotating while coming into contact with said corrugating medium for said heating process.

12. A single facer as defined in claim 2, wherein said humidifying and heating unit comprises a watering roll for applying water to said corrugating medium by rotating in a state of coming into contact with said corrugating medium for said humidification process and a heating roll for heating said corrugating medium by rotating while coming into contact with said corrugating medium for said heating process.

13. A single facer as defined in claim 1, wherein said humidifying and heating unit is constructed as a steam unit having an internal space filled with a high-temperature steam for conducting said humidification and heating process concurrently with respect to said corrugating medium passing through said internal space.

14. A single facer as defined in claim 3, wherein said humidifying and heating unit is constructed as a steam unit having an internal space filled with a high-temperature steam for conducting said humidification and heating process concurrently with respect to said corrugating medium passing through said internal space.

15. A single facer as defined in claim 2, wherein said humidifying and heating unit is constructed as a steam unit having an internal space filled with a high-temperature steam for conducting said humidification and heating process concurrently with respect to said corrugating medium passing through said internal space.

16. A single facer comprising:

a corrugating roll for corrugation-processing a corrugating medium;

an air pressurization corrugating mechanism for applying an air pressure to said corrugating medium to press said corrugating medium against said corrugating roll;

a pressing mechanism for pressing a linerboard, fed in a different way, against said corrugating medium corrugated by said air pressurization corrugating mechanism and said corrugating roll for adhesion therebetween, thereby producing a single faced corrugated fiberboard sheet;

a humidifying and heating unit placed on the upstream side of said air pressurization corrugating mechanism for humidifying and heating said corrugating medium as a humidification and heating process:

a feed mechanism for feeding said corrugating medium, processed by said humidifying and heating unit, to said air pressurization corrugating mechanism at a given speed; and a medium feed guide for guiding said corrugating medium toward the circumferential surface of said corrugating roll in such a manner that said corrugating medium defines with respect to a tangential line of said corrugating roll an angle θ when said corrugating medium is supplied into a gap between said air pressurization corrugating mechanism and said corrugating roll, said angle θ being complementary to a pressure angle of teeth of said corrugating roll with respect to a right angle subtending said tangential line and a line that extends radially outwardly of said corrugating roll and perpendicularly to said tangential line;

said humidifying and heating unit including a shower unit for spouting water to said corrugating medium for said humidification process, and a heating roll disposed downstream of said shower unit for heating said corrugating medium which has been exposed to the water spouted from said shower unit, by rotating while coming into contact with said corrugating medium for said heating process.

17. A single facer comprising:

a corrugating roll for corrugation-processing a corrugating medium;

an air pressurization corrugating mechanism for applying an air pressure to said corrugating medium to press said corrugating medium against said corrugating roll;

a pressing mechanism for pressing a linerboard, fed in a different way, against said corrugating medium corrugated by said air pressurization corrugating mechanism and said corrugating roll for adhesion therebetween thereby producing a single faced corrugated fiberboard sheet;

a humidifying and heating unit placed on the upstream side of said air pressurization corrugating mechanism for humidifying and heating said corrugating medium as a humidification and heating process;

a feed mechanism for feeding said corrugating medium, processed by said humidifying and heating unit, to said air pressurization corrugating mechanism at a given speed; and a medium feed guide for guiding said corrugating medium toward the circumferential surface of said corrugating roll in such a manner that said corrugating medium defines with respect to a tangential line of said corrugating roll an angle θ when said corrugating medium is supplied into a gap between said air pressurization corrugating mechanism and said corrugating roll, said angle θ being complementary to a pressure angle of teeth of said corrugating roll with respect to a right angle subtending said tangential line and a line that extends radially outwardly of said corrugating roll and perpendicularly to said tangential line;

said humidifying and heating unit including a watering roll for applying water to said corrugating medium by rotating in a state of coming into contact with said corrugating medium for said humidification process, and a heating roll disposed downstream of said watering roll for heating said corrugating medium, which has been exposed to the water applied from said watering roll, by rotating while coming into contact with said corrugating medium for said heating process.

18. A single facer comprising:

a corrugating roll for corrugation-processing a corrugating medium;

an air pressurization corrugating mechanism for applying an air pressure to said corrugating medium to press said corrugating medium against said corrugating roll;

a pressing mechanism for pressing a linerboard, fed in a different way, against said corrugating medium corrugated by said air pressurization corrugating mechanism and said corrugating roll for adhesion therebetween, thereby producing a single faced corrugated fiberboard sheet;

a humidifying and heating unit placed on the upstream side of said air pressurization corrugating mechanism for humidifying and heating said corrugating medium as a humidification and heating process;

a feed mechanism for feeding said corrugating medium, processed by said humidifying and heating unit, to said air pressurization corrugating mechanism at a given speed; and a medium feed guide for guiding said corrugating medium toward the circumferential surface of said corrugating roll in such a manner that said corrugating medium defines with respect to a tangential line of said corrugating roll an angle θ when said corrugating medium is supplied into a gap between said air pressurization corrugating mechanism and said corrugating roll, said angle θ being complementary to a pressure angle of teeth of said corrugating roll with respect to a right angle subtending said tangential line and a line that extends radially outwardly of said corrugating roll and perpendicularly to said tangential line;

said humidifying and heating unit being constructed as a steam unit having an internal space which holds a high-temperature steam inside and allows said corrugating medium to pass therethrough for conducting said humidification and heating process concurrently with respect to said corrugating medium passing through said internal space.

19. A single facer as defined in claim 16, further comprising an air suction mechanism for sucking air between said corrugating roll and said corrugating medium so that said corrugating medium is drawn to the circumferential surface of said corrugating roll.

20. A single facer as defined in claim 17, further comprising an air suction mechanism for sucking air between said corrugating roll and said corrugating medium so that said corrugating medium is drawn to the circumferential surface of said corrugating roll.

21. A single facer as defined in claim 18, further comprising an air suction mechanism for sucking air between said corrugating roll and said corrugating medium so that said corrugating medium is drawn to the circumferential surface of said corrugating roll.

22. A single facer as defined in claim 16, wherein said feed mechanism includes:

a feed roller rotatable in contact with said corrugating medium to move said corrugating medium forwardly into said air pressurization corrugating mechanism at said given speed;

a feed roller rotating motor for driving said feed roller for rotation;

a feed roller controller for controlling the operation of said feed roller rotating motor to vary the rotational speed of said feed roller;

a corrugating roll rotating motor for driving said corrugating roll for rotation; and a corrugating roll controller for controlling the operation of said corrugating roll rotating motor to vary the rotational speed of said corrugating roll;

said corrugating roll controller being able to transmit information indicative of said rotational speed of said corrugating roll to said feed roller controller, while said feed roller controller controls the operation of said feed roller rotating motor so that said feed roller is rotated at a rotational speed obtained by multiplying said rotational speed, which is transmitted from said corrugating roll controller, by a take-up ratio of said corrugating roll.

23. A single facer as defined in claim 17, wherein said feed mechanism includes:

a feed roller rotatable in contact with said corrugating medium to move said corrugating medium forwardly into said air pressurization corrugating mechanism at said given speed;

a feed roller rotating motor for driving said feed roller for rotation;

a feed roller controller for controlling the operation of said feed roller rotating motor to vary the rotational speed of said feed roller;

a corrugating roll rotating motor for driving said corrugating roll for rotation; and a corrugating roll controller for controlling the operation of said corrugating roll rotating motor to vary the rotational speed of said corrugating roll;

said corrugating roll controller being able to transmit information indicative of said rotational speed of said corrugating roll to said feed roller controller, while said feed roller controller controls the operation of said feed roller rotating motor so that said feed roller is rotated at a rotational speed obtained by multiplying said rotational speed, which is transmitted from said corrugating roll controller, by a take-up ratio of said corrugating roll.

24. A single facer as defined in claim 18, wherein said feed mechanism includes:

a feed roller rotatable in contact with said corrugating medium to move said corrugating medium forwardly into said air pressurization corrugating mechanism at said given speed;

a feed roller rotating motor for driving said feed roller for rotation;

a feed roller controller for controlling the operation of said feed roller rotating motor to vary the rotational speed of said feed roller;

a corrugating roll rotating motor for driving said corrugating roll for rotation; and a corrugating roll controller for controlling the operation of said corrugating roll rotating motor to vary the rotational speed of said corrugating roll;

said corrugating roll controller being able to transmit information indicative of said rotational speed of said corrugating roll to said feed roller controller, while said feed roller controller controls the operation of said feed roller rotating motor so that said feed roller is rotated at a rotational speed obtained by multiplying said rotational speed, which is transmitted from said corrugating roll controller, by a take-up ratio of said corrugating roll.

25. A single facer as defined in claim 1, wherein said pressing mechanism is constructed as a belt pressurization mechanism including an endless pressure belt for pressing said linerboard to the corrugating roll side in a state where said corrugating medium corrugation-processed is interposed between said linerboard and said corrugating roll.

26. A single facer as defined in claim 16, wherein said pressing mechanism is constructed as a belt pressurization mechanism including an endless pressure belt for pressing said linerboard to the corrugating roll side in a state where said corrugating medium corrugation-processed is interposed between said linerboard and said corrugating roll.

27. A single facer as defined in claim 17, wherein said pressing mechanism is constructed as a belt pressurization mechanism including an endless pressure belt for pressing said linerboard to the corrugating roll side in a state where said corrugating medium corrugation-processed is interposed between said linerboard and said corrugating roll.

28. A single facer as defined in claim 18, wherein said pressing mechanism is constructed as a belt pressurization mechanism including an endless pressure belt for pressing said linerboard to the corrugating roll side in a state where said corrugating medium corrugation-processed is interposed between said linerboard and said corrugating roll.

29. A single facer as defined in claim 1, further comprising a noise intercepting structure located around said air pressurization corrugating mechanism for intercepting noises generated by said air pressurization corrugating mechanism.

30. A single facer as defined in claim 16, further comprising a noise intercepting structure located around said air pressurization corrugating mechanism for intercepting noises generated by said air pressurization corrugating mechanism.

31. A single facer as defined in claim 17, further comprising a noise intercepting structure located around said air pressurization corrugating mechanism for intercepting noises generated by said air pressurization corrugating mechanism.

32. A single facer as defined in claim 18, further comprising a noise intercepting structure located around said air pressurization corrugating mechanism for intercepting noises generated by said air pressurization corrugating mechanism.

* * * * *